US008353177B2

(12) United States Patent
Adamski et al.

(10) Patent No.: US 8,353,177 B2
(45) Date of Patent: Jan. 15, 2013

(54) APPARATUS AND METHOD FOR DISPENSING ICE FROM A BOTTOM MOUNT REFRIGERATOR

(75) Inventors: Joseph R. Adamski, Pasadena, CA (US); Jason Colsch, Shellsburg, IA (US); Tim L. Coulter, Cedar Rapids, IA (US); Glenn E. Goetz, East Amana, IA (US); Steven G. Herndon, Cedar Rapids, IA (US); Todd E. Kniffen, Williamsburg, IA (US); Bill J. Koons, Cedar Rapids, IA (US); Lou Montuoro, Cedar Rapids, IA (US); John H. Tenhundfeld, Cedar Rapids, IA (US); David Thalacker, Fairfax, IA (US); Brett Vladika, Milwaukee, WI (US)

(73) Assignee: Whirlpool Corporation, Benton Harbor, MI (US)

( * ) Notice: Subject to any disclaimer, the term of this patent is extended or adjusted under 35 U.S.C. 154(b) by 653 days.

(21) Appl. No.: 11/236,126

(22) Filed: Sep. 27, 2005

(65) Prior Publication Data

US 2006/0090496 A1 May 4, 2006

Related U.S. Application Data

(60) Provisional application No. 60/613,241, filed on Sep. 27, 2004.

(51) Int. Cl.
*F25D 11/02* (2006.01)

(52) U.S. Cl. ..... 62/344

(58) Field of Classification Search ..... 62/340, 62/344, 351, 353
See application file for complete search history.

(56) References Cited

U.S. PATENT DOCUMENTS

| | | | |
|---|---|---|---|
| 1,017,197 | A | 2/1912 | Barnes |
| 1,064,314 | A | 6/1913 | German |
| 1,377,411 | A | 5/1921 | Douglas |
| 1,377,455 | A | 5/1921 | Beidler |
| 1,604,621 | A | 10/1926 | Wallace |
| 2,712,733 | A | 7/1955 | King |
| 2,765,633 | A | 10/1956 | Muffly |
| 2,779,165 | A | 1/1957 | Pichler |
| 3,025,679 | A | 3/1962 | Keighley |
| 3,122,005 | A | 2/1964 | Costantini |

(Continued)

FOREIGN PATENT DOCUMENTS

EP 0 715 136 A1 6/1996

(Continued)

OTHER PUBLICATIONS

Anderson, Ronald K., U.S. Appl. No. 11/140,100, filed May 27, 2005, Refrigerator With Improved Icemaker.

(Continued)

*Primary Examiner* — Melvin Jones
(74) *Attorney, Agent, or Firm* — Kirk W. Goodwin; McKee Vorhees & Sease

(57) ABSTRACT

A bottom mount household refrigerator is provided with an apparatus to permit the dispensing of ice. According to one embodiment, a sealed ice making compartment is provided within the fresh food compartment. The sealed ice making compartment may be located at the bottom, at the top, or along a side wall within the fresh food compartment. According to another embodiment, ice is made in the ice compartment, and lifted upward to a dispensing location through the door of the fresh food compartment.

10 Claims, 20 Drawing Sheets

U.S. PATENT DOCUMENTS 3,146,601 A * 9/1964 Gould ..... 62/3.6
3,146,606 A * 9/1964 Grimes et al. ..... 62/233
3,151,472 A 10/1964 Harle
3,226,939 A 1/1966 Harbison
3,270,519 A 9/1966 Pohl, Jr.
3,308,631 A 3/1967 Kniffin
3,350,899 A 11/1967 Jones
3,359,751 A 12/1967 Stevens
3,429,140 A 2/1969 White
3,440,308 A 4/1969 Carbary
3,561,231 A 2/1971 Webb
3,602,007 A 8/1971 Drieci
3,633,374 A 1/1972 Canter
3,640,088 A 2/1972 Jacobus
3,745,779 A 7/1973 Bright
3,747,363 A 7/1973 Grimm
3,775,994 A 12/1973 Linstromberg
3,789,620 A 2/1974 Benasutti
3,834,177 A 9/1974 Scarlett
3,866,434 A 2/1975 Pugh
3,889,888 A 6/1975 Prada
3,902,331 A 9/1975 True
3,969,909 A 7/1976 Barto et al.
3,972,204 A 8/1976 Sidorenko
4,007,600 A 2/1977 Simms
4,020,644 A 5/1977 True
4,084,725 A 4/1978 Buchser
4,087,140 A 5/1978 Linstromberg
4,100,761 A 7/1978 Linstromberg
4,118,451 A 10/1978 Schaus
4,142,373 A 3/1979 Weibel
4,142,377 A 3/1979 Fogt
4,142,378 A 3/1979 Bright
4,209,999 A 7/1980 Falk et al.
4,227,383 A 10/1980 Horvay
4,250,923 A 2/1981 Johnson
4,280,682 A 7/1981 Zukausky
4,285,212 A 8/1981 Prada
4,306,757 A 12/1981 Horvay
4,332,146 A 6/1982 Yamazaki
4,333,588 A 6/1982 Schreck
4,543,800 A 10/1985 Mawby
4,614,088 A 9/1986 Brooks
4,732,009 A 3/1988 Frohbieter
4,835,978 A 6/1989 Cole
4,838,026 A 6/1989 Searl
4,889,316 A 12/1989 Donahue
4,922,725 A 5/1990 Rasmussen
4,970,871 A 11/1990 Rudick
4,997,109 A 3/1991 Carper
5,033,636 A 7/1991 Jenkins
5,037,004 A 8/1991 Katz
5,056,688 A 10/1991 Goetz
5,077,985 A 1/1992 Buchser
5,117,654 A 6/1992 Steffenhagen
5,165,255 A 11/1992 Alvarez et al.
5,198,244 A 3/1993 Rice
5,211,462 A 5/1993 Bien
5,212,955 A 5/1993 Hogan
5,261,248 A 11/1993 Willis
5,272,888 A 12/1993 Fisher
5,273,219 A 12/1993 Beach
5,310,090 A 5/1994 Taylor
5,327,856 A 7/1994 Schroeder
5,355,686 A 10/1994 Weiss
5,359,795 A 11/1994 Mawby et al.
5,375,432 A * 12/1994 Cur ..... 62/320
5,542,264 A 8/1996 Hortin
5,596,182 A 1/1997 Edwards
5,729,997 A 3/1998 Witsoe
5,737,932 A 4/1998 Lee
5,787,724 A 8/1998 Pohl et al.
5,810,331 A 9/1998 Smock
5,813,245 A 9/1998 Coates et al.
5,816,060 A 10/1998 Brownell
5,823,001 A 10/1998 Patrick
5,834,126 A 11/1998 Sheu
5,849,227 A 12/1998 Chikugo
5,899,083 A 5/1999 Peterson
5,947,342 A 9/1999 Song
5,956,967 A 9/1999 Kim
5,992,167 A 11/1999 Hill
6,019,447 A 2/2000 Jackovin
6,050,097 A 4/2000 Nelson
6,053,472 A 4/2000 DeLand
6,062,826 A 5/2000 Morimoto
6,082,130 A 7/2000 Pastryk
6,120,685 A 9/2000 Carlson et al.
6,135,173 A 10/2000 Lee et al.
6,148,620 A 11/2000 Kumagai
6,148,624 A 11/2000 Bishop
6,176,099 B1 * 1/2001 Hynes ..... 62/344
6,276,146 B1 8/2001 Kim et al.
6,286,324 B1 9/2001 Pastryk
6,314,745 B1 11/2001 Janke
6,351,958 B1 3/2002 Pastryk
6,438,976 B2 8/2002 Shapiro
6,442,954 B1 9/2002 Shapiro
6,460,367 B1 10/2002 DuHack
6,474,094 B2 11/2002 Kim
6,532,758 B2 3/2003 DuHack
6,571,567 B2 6/2003 An et al.
6,574,974 B1 6/2003 Herzog
6,604,377 B2 8/2003 Watanabe
6,655,166 B1 12/2003 Williams
6,708,726 B2 3/2004 Hashimoto
6,735,959 B1 5/2004 Najewicz
6,742,353 B2 6/2004 Ohashi et al.
6,755,166 B2 6/2004 Chang
6,810,682 B1 11/2004 Schuchart et al.
6,880,355 B2 4/2005 Jung
6,964,177 B2 11/2005 Lee
7,065,975 B1 6/2006 Herndon et al.
7,076,967 B2 7/2006 Lee et al.
7,188,479 B2 * 3/2007 Anselmino et al. ..... 62/66
7,222,497 B2 5/2007 An
7,222,498 B2 5/2007 Lee
7,228,701 B2 6/2007 Kim
7,392,665 B2 7/2008 Lee et al.
7,428,820 B2 9/2008 Kim et al.
7,484,382 B2 2/2009 Kim et al.
7,490,475 B2 2/2009 Kim et al.
2001/0025505 A1 10/2001 Nelson
2002/0083731 A1 7/2002 Kim
2003/0126881 A1 7/2003 Lee
2004/0148957 A1 8/2004 Pohl
2005/0061016 A1 3/2005 Lee et al.
2006/0090496 A1 5/2006 Adamski et al.
2006/0218961 A1 10/2006 Kim
2007/0074527 A1 4/2007 Lee
2007/0095080 A1 5/2007 An
2007/0103940 A1 5/2007 Chung

FOREIGN PATENT DOCUMENTS

EP 0716278 A1 2/1997
EP 1 482 263 A2 1/2004
EP 1445558 A2 11/2004
EP 1 517 103 A2 3/2005
EP 1 519 131 Al 3/2005
JP US47026464 11/1972
JP 500 69644 6/1975
JP 50069644 A 6/1975
JP US50154565 A 12/1975
JP US5341815 A 11/1978
JP US5694462 U 7/1981
JP 356 113 417 A 9/1981
JP 04 124570 A 4/1992
JP 060 11228 A 1/1994
JP H06-33326 B 8/1994
JP H07-190578 A 7/1995
JP H10-148437 A 6/1998
JP H10-188125 A 7/1998
JP H10-197119 A 7/1998
JP H10-206004 A 8/1998
JP 1999325691 A 11/1999
JP 2000009372 A 1/2000
JP 20000 65458 A 3/2000

| | | | |
|---|---|---|---|
| JP | 2000105052 | A | 4/2000 |
| JP | 2000111229 | A | 4/2000 |
| JP | 2000146421 | A | 5/2000 |
| JP | 2000320943 | A | 11/2000 |
| JP | 2001221555 | A | 8/2001 |
| JP | 2002162139 | A | 6/2002 |
| JP | 2002350021 | A | 12/2002 |
| JP | 2002372349 | A | 12/2002 |
| JP | 2003056966 | A | 2/2003 |
| JP | 2003075050 | A | 3/2003 |
| JP | 2003090667 | A | 3/2003 |
| JP | 2003-121043 | A | 4/2003 |
| JP | 2003121043 | A | 4/2003 |
| JP | 2006011228 | A | 1/2006 |
| KR | 19970001294 | B1 | 2/1997 |
| KR | 1998018912 | U | 7/1998 |
| KR | 1999021017 | A | 3/1999 |
| KR | 1999030143 | A | 4/1999 |
| KR | 19970001293 | A | 5/1999 |
| KR | 19990031465 | A | 5/1999 |
| KR | 19990021540 | U | 6/1999 |
| KR | 19990043740 | A | 6/1999 |
| KR | 19990062189 | A | 7/1999 |
| KR | 19990065602 | A | 8/1999 |
| KR | 19990066209 | A | 8/1999 |
| KR | 20000028513 | A | 5/2000 |
| KR | 20000050416 | A | 8/2000 |
| KR | 20010008710 | A | 2/2001 |
| KR | 20010029590 | A | 4/2001 |
| KR | 19970062375 | B1 | 6/2002 |
| WO | 03033976 | A1 | 4/2003 |
| WO | 03102481 | A1 | 12/2003 |
| WO | WO 03/102481 | A1 | 12/2003 |
| WO | WO 2004/085937 | A1 | 10/2004 |

OTHER PUBLICATIONS

Coulter, Tim, U.S. Appl. No. 11/139,237, filed May 27, 2005, Insulated Ice Compartment for Bottom Mount Refrigerator.

Van Meter, Kyle B., U.S. Appl. No. 11/131,701, filed May 18, 2005, Refrigerator With Intermediate Temperature Icemaking Compartment.

Reexam of U. S. Patent No. 7,484,382, Control No. 95/001,480: EfilingAck receipt for Reexam 382 filing HOU03 1254364 1.

Reexam of U. S. Patent No. 7,484,382, Control No. 95/001,480: Exhibit 1—Kim 7,484,382.

Reexam of U. S. Patent No. 7,484,382, Control No. 95/001,480: Exhibit 2—IDS 0382.

Reexam of U. S. Patent No. 7,484,382, Control No. 95/001,480: Exhibit 3—Yasuzo JP2000-009372.

Reexam of U. S. Patent No. 7,484,382, Control No. 95/001,480: Exhibit 4—Najewicz 6,735,959.

Reexam of U. S. Patent No. 7,484,382, Control No. 95/001,480: Exhibit 5—Cur 5,375,432.

Reexam of U. S. Patent No. 7,484,382, Control No. 95/001,480: Exhibit 6—Fischer 5,272,888.

Reexam of U. S. Patent No. 7,484,382, Control No. 95/001,480: Exhibit 7—Buchser 5,077,985.

Reexam of U. S. Patent No. 7,484,382, Control No. 95/001,480: Exhibit 8—Shin KR2001-0029590.

Reexam of U. S. Patent No. 7,484,382, Control No. 95/001,480: Exhibit 9—Haag 4,226,489.

Reexam of U. S. Patent No. 7,484,382, Control No. 95/001,480: Exhibit 10—Lee 6,964,177.

Reexam of U. S. Patent No. 7,484,382, Control No. 95/001,480: Exhibit 11—Chekal 7,008,032.

Reexam of U. S. Patent No. 7,484,382, Control No. 95/001,480: POA 382.

Reexam of U. S. Patent No. 7,484,382, Control No. 95/001,480: Request Inter Partes Reexam 382.

Reexam of U. S. Patent No. 7,484,382, Control No. 95/001,480: Transmittal Reexam 382.

Reexam of U. S. Patent No. 7,490,475, Control No. 95/001,481: EfilingAck receipt for Reexam 475 HOU03 1254375 1.

Reexam of U. S. Patent No. 7,490,475, Control No. 95/001,481: Exhibit 1—475 Patent.

Reexam of U. S. Patent No. 7,490,475, Control No. 95/001,481: Exhibit 2—IDS 475 Reexam.

Reexam of U. S. Patent No. 7,490,475, Control No. 95/001,481: Exhibit 3—Cur 5,375,432.

Reexam of U. S. Patent No. 7,490,475, Control No. 95/001,481: Exhibit 4—Najewicz 6,735,959.

Reexam of U. S. Patent No. 7,490,475, Control No. 95/001,481: Exhibit 5—Yasuzo JP2000-009372.

Reexam of U. S. Patent No. 7,490,475, Control No. 95/001,481: Exhibit 6—Kwon KR2000-0073340.

Reexam of U. S. Patent No. 7,490,475, Control No. 95/001,481: Exhibit 7—Oh KR1999-021017.

Reexam of U. S. Patent No. 7,490,475, Control No. 95/001,481: Exhibit 8—Kim KR1999-0031494.

Reexam of U. S. Patent No. 7,490,475, Control No. 95/001,481: Exhibit 9—Park KR1998-0189120.

Reexam of U. S. Patent No. 7,490,475, Control No. 95/001,481: Exhibit 10—Kim KR1999-0066209.

Reexam of U. S. Patent No. 7,490,475, Control No. 95/001,481: Exhibit 11—Coates 5,813,245.

Reexam of U. S. Patent No. 7,490,475, Control No. 95/001,481: POA.

Reexam of U. S. Patent No. 7,490,475, Control No. 95/001,481: Request Reexam 475.

Reexam of U. S. Patent No. 7,490,475, Control No. 95/001,481: Transmittal 475 Reexam.

* cited by examiner

APPARATUS AND METHOD FOR DISPENSING ICE FROM A BOTTOM MOUNT REFRIGERATOR

CROSS-REFERENCE TO RELATED APPLICATIONS

This application is a conversion of and claims priority to U.S. Provisional Patent Application No. 60/613,241 filed Sep. 27, 2004, which is herein incorporated by reference in its entirety.

TECHNICAL FIELD

This invention relates generally to a method and apparatus for dispensing ice from a consumer-type refrigerator, and more particularly to providing ice dispensing capability for a bottom mount refrigerator.

BACKGROUND OF THE INVENTION

Consumer refrigerators such as might be found in a household typically include a fresh food compartment and a freezer compartment. The refrigerator is provided with an evaporator for maintaining the fresh food compartment at a temperature range of about 32-40 degrees Fahrenheit. The same or an additional evaporator may be used to maintain the freezer compartment below freezing, usually near 0 degrees Fahrenheit.

Traditionally, the freezer compartment has been provided above the fresh food compartment in a so-called top mount refrigerator. The freezer compartment may also be located side-by-side with the fresh food compartment. A bottom mount refrigerator is one in which the freezer compartment is mounted below the fresh food compartment. These bottom mount refrigerators are popular because they provide easier access to the fresh food compartment, and provide relatively more useful storage space than the freezer section of a similarly sized side-by-side model.

Ice makers are commonly provided within the freezer compartments of consumer refrigerators to automatically make ice. These ice makers are attached to a water line to provide fresh water to make ice. A sensing mechanism is provided to determine when the supply needs to be replenished and more ice made. There are numerous well-known structures for making and storing ice in the freezer compartment of a consumer refrigerator.

A popular feature on consumer refrigerators that include automatic ice makers, especially side-by-side models, is ice dispensing through the freezer door. According to this feature, a user can obtain ice without opening the door to the freezer compartment. A passage, cavity, or the like is provided through the door to the freezer, and ice can be automatically dispensed from the ice maker in the freezer compartment through the freezer door. Preferably the ice is dispensed at a convenient height for a user. Bottom mount refrigerators have presented a unique challenge because the freezer compartment is located lower than desired for an ice dispensing location. If the ice is formed in the bottom mount freezer compartment, it is necessary to lift the ice to dispense it at a comfortable dispensing height. Heretofore, this has not been practical.

SUMMARY OF THE INVENTION

According to one embodiment of the present invention, an ice making compartment is provided within a lower corner of the fresh food compartment. This ice making compartment is sealed and insulated from the fresh food compartment. A dispensing port is provided through a door to the fresh food compartment. Ice can be dispensed from the ice making compartment through the dispensing port. An inclined ice bucket and auger with solid flights may be used as a transport device to transport the ice to the dispensing port. The ice making compartment may be open to the freezer compartment located below. Overflow ice from the inclined ice bucket may fall to a storage bin in the freezer compartment. A dispensing mechanism, such as a pick-up wheel, may be incorporated between the transport system and the dispensing port. An ice crusher may also be included between the transport device and the dispensing port.

According to another embodiment of the present invention, an ice making compartment is provided midway along a sidewall of the fresh food compartment. This ice making compartment is sealed and insulated from the fresh food compartment. A dispensing port is provided through a door to the fresh food compartment. Ice can be dispensed from the ice making compartment through the dispensing port. A standard transport device may be used to transport the ice to the dispensing port. A dispensing mechanism, such as a pick-up wheel, may be incorporated between the transport system and the dispensing port. An ice crusher may also be included between the transport device and the dispensing port.

According to another embodiment of the present invention, an ice making compartment is provided at an upper corner of the fresh food compartment. This ice making compartment is sealed and insulated from the fresh food compartment. An ice storage compartment is provided in a door to the fresh food compartment. A dispensing port is provided through the door to the fresh food compartment between the ice storage compartment and a dispensing location. Ice may be transported from the ice making compartment to the ice storage compartment by gravity feed. A dispensing mechanism, such as a pick-up wheel, may be incorporated between the ice storage compartment and the dispensing port. An ice crusher may also be included.

The specific techniques and structures employed by the invention to improve over the drawbacks of the prior systems and accomplish the advantages described above will become apparent from the following detailed description of exemplary embodiments of the invention and the appended drawings and claims.

DETAILED DESCRIPTION OF THE PREFERRED EMBODIMENT

Figure 1:
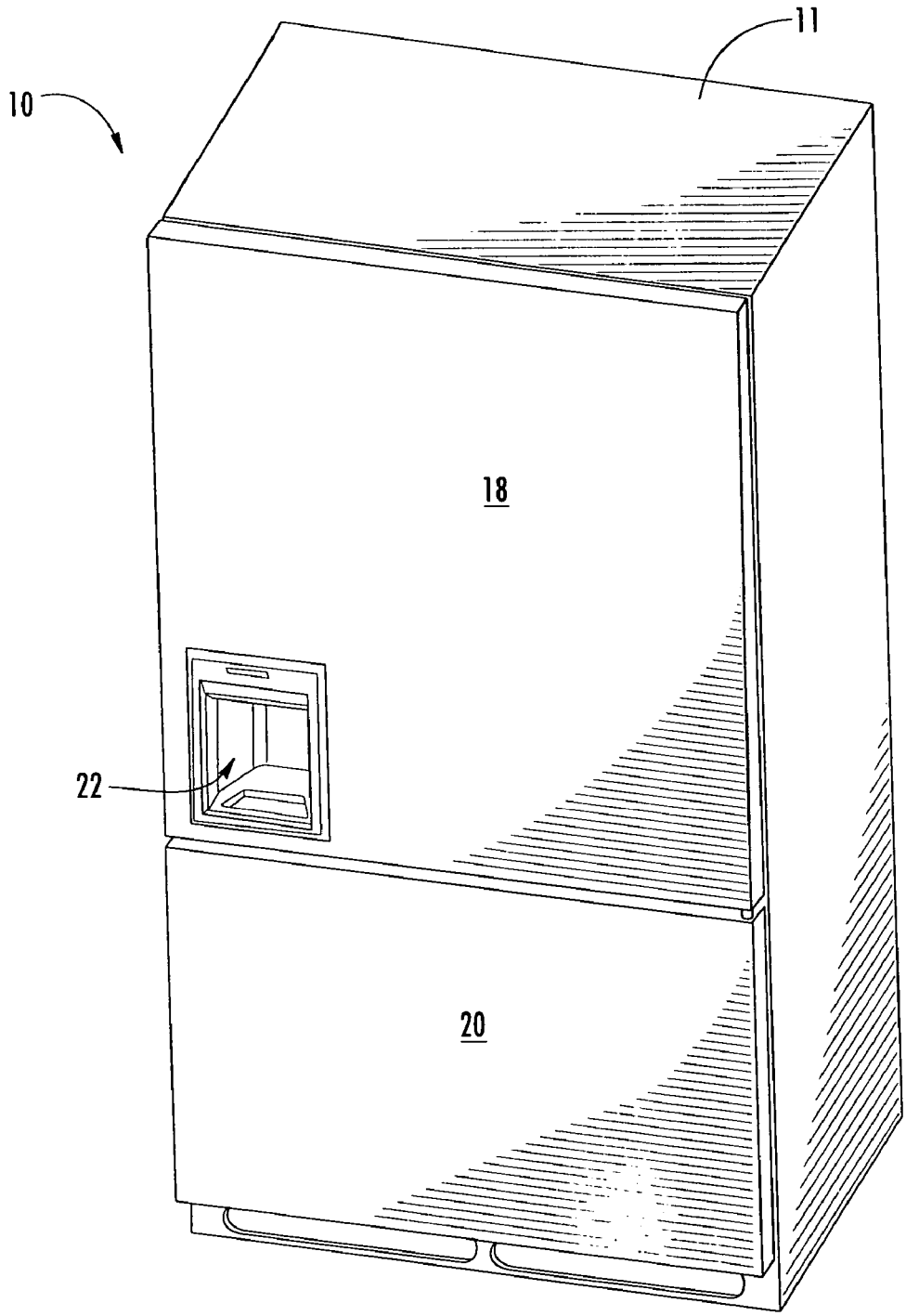
FIG. 1 is a perspective view of a first exemplary embodiment of the present invention' showing a bottom mount refrigerator with an ice making compartment provided in a lower corner of the fresh food compartment.
Figure 2:
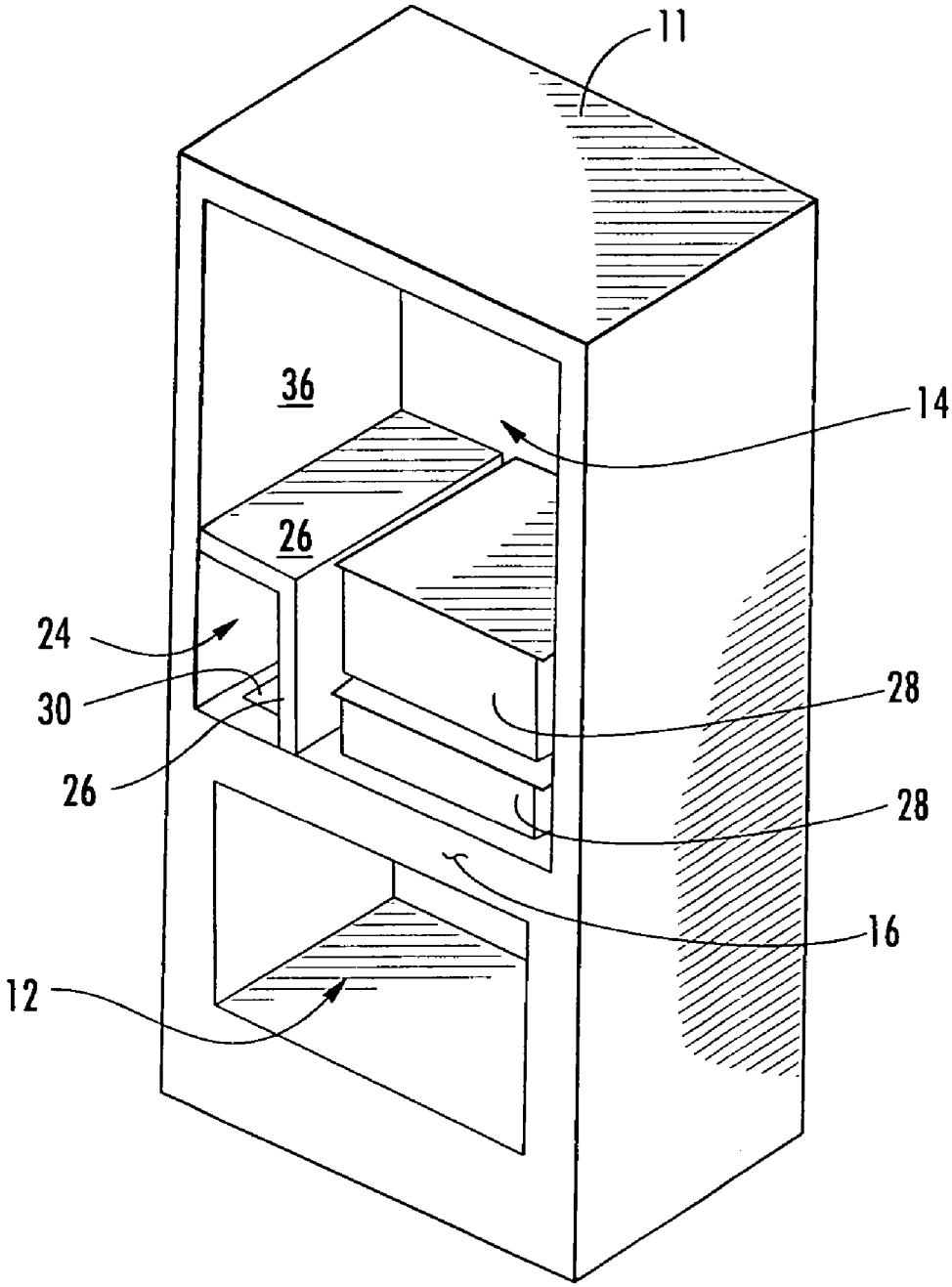
FIG. 2 is a perspective view of the refrigerator of FIG. 1 with the doors removed.
Figure 3:
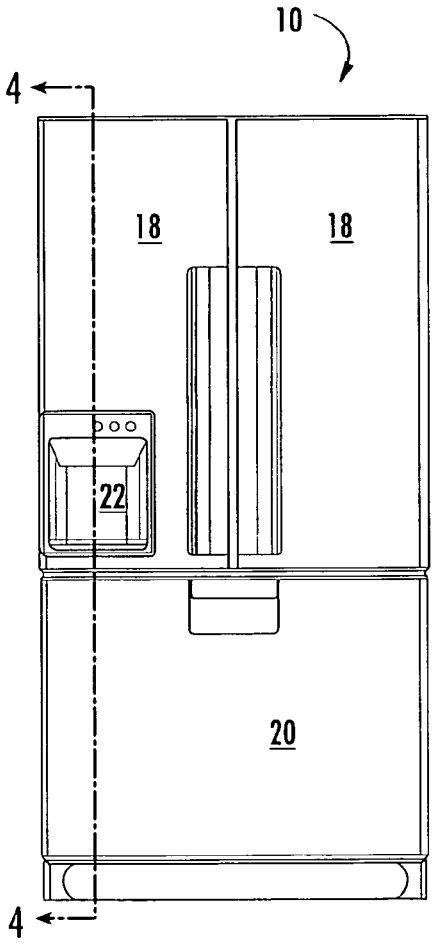
FIG. 3 is a front view of another exemplary embodiment of the present invention showing a bottom mount refrigerator with an ice making compartment provided in a lower corner of the fresh food compartment, and having two top doors covering the fresh food compartment.

Shown generally in the figures is a bottom mount refrigerator 10 that is adapted to dispense ice to a user. FIG. 1 shows the exterior of an embodiment of such a refrigerator 10. FIG. 2 shows the refrigerator of FIG. 1 with the doors 18 and 20 removed. The preferred use for the refrigerator 10 is in a household consumer setting. The refrigerator 10 includes an insulated cabinet 11 with a freezer compartment 12 and a fresh food compartment 14 above the freezer compartment 12. An insulated divider wall 16 separates the freezer compartment 12 from the fresh food compartment 14, and also serves as the top wall of the freezer compartment 12 and the bottom wall of the fresh food compartment 14. A top door 18 encloses the fresh food compartment 14, and a bottom door 20 encloses the freezer compartment 12. The doors 18 and 20 are preferably insulated and provided with gaskets (not shown) or similar features around their periphery to provide a relatively airtight seal with the cabinet 11 and divider wall 16. Handles or grips (not shown in FIG. 1) may be provided on the doors 18 and 20 to provide a means of opening the doors 18 and 20. Preferably the doors 18 and 20 are reversible so that they may be mounted to cabinet 11 on either the left or right side. Alternatively, the single top door 18 covering the fresh food compartment 14 may be replaced with two top doors, as shown in FIG. 3. A dispensing area 22 is provided in the top door 18 to permit ice, and preferably also water, to be dispensed through the door 18. A chilling device (not shown), such as a compressor and evaporator, is provided to cool the interior of the cabinet 11.

Typically the freezer compartment 12 will be maintained at a temperature near 0 degrees Fahrenheit (−18 degrees C.) and the fresh food compartment 14 will be maintained at a temperature slight above freezing temperature for water (32 degrees F., 0 degrees C.). Controls such as variable speed fans and dampers, timers, or thermostats may be provided to adjust and maintain the desired temperatures in the compartments 12 and 14.

As seem in FIG. 2, a sealed ice compartment 24 is provided at the lower left corner of the fresh food compartment 14. The ice compartment 24 is isolated from the fresh food compartment 14 by insulated walls 26. An opening 30 may be provided through the divider wall 16 to permit passage of air between the freezer compartment 12 and the ice compartment 24. The fresh food compartment may also include additional compartments such as crisper drawers 28 for retaining fruits, vegetable, meats, cheeses, and the like.

Figure 4:
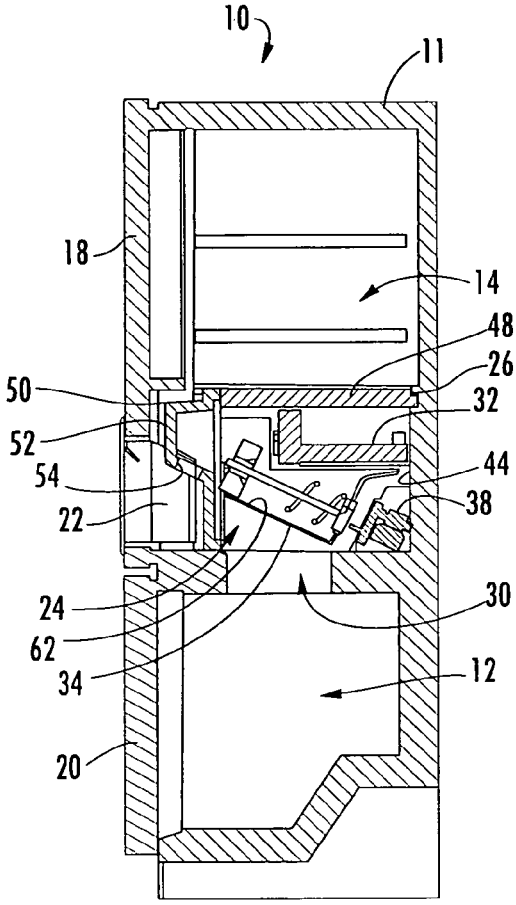
FIG. 4 is a cross-sectional view of the refrigerator of FIG. 3 taken along line 4-4.

As seen in FIG. 4, an ice maker 32 (not shown in FIG. 2) is located in the ice compartment 24. A water line (not shown) supplies fresh water to the ice maker 32. The ice maker 32 will automatically make ice cubes, which preferably can be dispensed through the door 18 to the dispensing area 22. Those of skill in the art will be aware of numerous alternatives for ice makers. Also included within the ice compartment 24 is a storage container 34 for storing the ice after it is made, and a dispensing mechanism for selectively moving the ice from the storage container to the dispensing area 22. The dispensing mechanism may include structure for crushing the ice, if desired.

Figure 5:
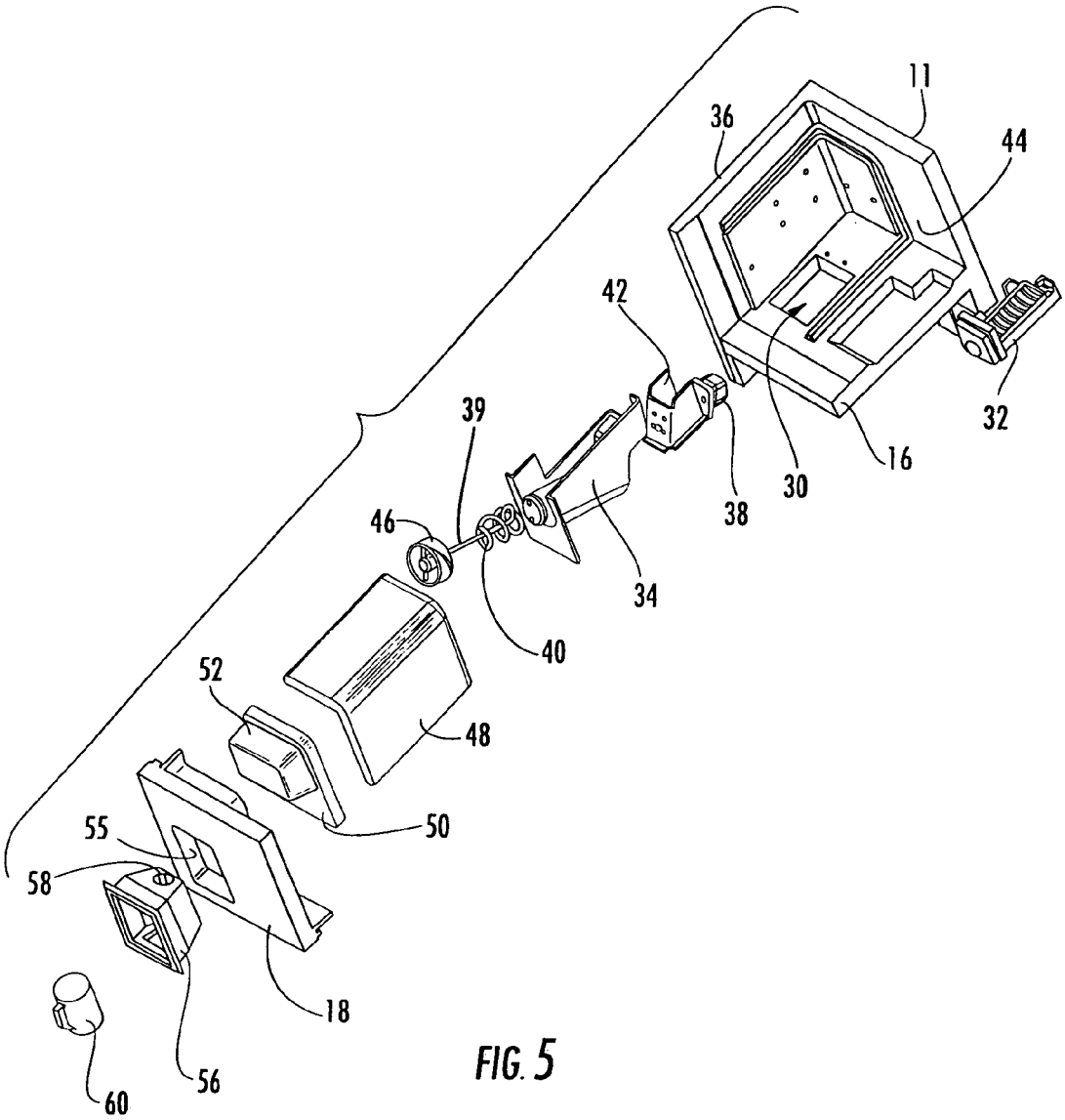
FIG. 5 is an exploded view of several components from the refrigerator of FIGS. 3 and 4.

FIGS. 3-5 show an embodiment of a refrigerator 10 that includes two top doors 18 covering the fresh food compartment 14. The dispensing area 22 is provided through one of the top doors 18 to permit dispensing of ice to a user through one of the doors 18. According to this embodiment, the ice maker 32 is mounted to an interior surface of one of the side walls 36 of the cabinet 11. Brackets and typical mounting hardware (not shown) are used to attach the ice maker 32 to the side wall 36. The ice compartment 24 is located at the lower corner of the fresh food compartment 14. FIG. 5 shows an exploded view of many of the elements of the dispensing mechanism and ice compartment 24 of this embodiment.

As seen in FIGS. 4 and 5, the opening 30 in the divider wall 16 permits free flow of air between the freezer compartment 12 and the ice compartment 24. A motor 38 is provided to turn a shaft 39 attached to an auger 40. A housing 42 is provided to cover the motor 38, which gets mounted at a junction between the divider wall 16 and a rear interior wall 44 of the cabinet 11. The housing 42 is a flame resistance material, such as sheet metal, to satisfy UL requirements. A dispenser 46 is provided at a free end of the shaft 39. A casing 48 forms the insulated walls 26 of the ice compartment 24. An ice compartment cover 50 sealingly engages the front of the casing 48, the divider wall 16, and the side wall 36 of the cabinet 11 to form the sealed ice compartment 24. The cover 50 includes a protrusion 52 that extends at least partially above the ice dispensing area 22. A lower surface of the protrusion 52 has an opening 54 to permit ice to be dispensed from the ice compartment 24 to the dispensing area 22. A flap may be provided to cover opening 54 in order to insulate and seal the ice compartment from outside air, and to prevent ice from falling into the dispensing area 22 when not desired. The top door 18 has a passageway 55 into which dispensing area shell 56 can be inserted. The shell 56 defines the covered dispensing area 22, and is open at the front to permit a glass 60 to be placed in the dispensing area 22. A top surface of the shell 56 has an aperture 58 that aligns with the opening 54 in the ice compartment cover 50 to permit ice to pass to the glass 60.

With further reference to the embodiment of FIGS. 3-5, it can be seen that as ice is formed by the icemaker 32, it will fall into the storage container 34. A metering device may be provided to shut the icemaker 32 off when the storage container 34 is full. The storage container 34 has a sloped bottom surface 62. This sloped bottom surface 62 helps in moving the ice upward to the proper height for dispensing. In the embodiment shown, the sloped bottom surface 62 is tilted at an angle of about 35 degrees. As shown in later embodiments, it may be desirable to provide the auger 40 with solid flights in order to better lift the ice up the incline. It should also be appreciated that the storage container 34 will likely be significantly smaller than the storage containers in most existing conventional refrigerators with ice making. For this reason, it may be desirable to provide a second icemaker in the freezer compartment 12 that is associated with another storage container. Alternatively, a second storage container may be placed in the freezer compartment 12 aligned directly under opening 30. As excess ice is made by the icemaker 32, it will over overflow the storage container 34 and fall through the opening 30 into the second storage container. This would permit the storage of a greater volume of ice. It would require some sort of metering device to be attached to the second storage container, so that the icemaker 32 would shut off when both storage containers were full.

The flow of cold air from the freezer compartment 12 by natural convection may be sufficient to form ice in the ice maker 32. Alternatively, it may be desirable to use forced airflow, as by fans and the like to increase the heat exchange at the ice maker 32. Additionally, though not shown in this embodiment, it may be desirable to add a vent that directs cold air from the compressor/evaporator to the ice compartment 24, preferably proximate to the ice maker 32. The large opening 30 between the ice compartment 24 and the freezer compartment 12 would allow easy flow of such air without creating a large load on the fan.

An activation trigger is provided to activate the dispensing mechanism when it is desired to dispense ice. Typically the trigger will be a lever that is pressed, as by pushing the glass 60 against the lever, to initiate a dispensing occurrence. Alternatively, the trigger could be a proximity sensor that senses when the glass 60 has been placed in position within the dispensing area 22. Once the dispensing mechanism has been triggered, the motor 38 is activated and in turn rotates the auger 40. The rotation of the auger 40 pushes ice up the sloped surface 62 to the dispenser 46. The dispenser 46 is also rotated by the shaft 39, and slowly delivers ice to the projection 52. The flaps covering the opening in the projection 52 and the opening 58 in the shell 56 are retracted to permit ice to drop into the dispensing area 22 and into the container 60. When the glass 60 is withdrawn, the trigger mechanism shuts off the motor 38 to stop the rotation of the shaft 39, the auger 40, and the dispenser 46.

The embodiment of FIGS. 3-5 utilizes an icemaker 32 that mounts to the sidewall 36 of the cabinet 11. This is advantageous because it permits the long dimension of the icemaker 32 to be oriented parallel to the sidewall 36 so that it is completely contained by the depth of the fresh food compartment 14. Mounting the icemaker 32 to the sidewall 36 improves access to the icemaker 32 for serviceability. However, another option is to mount the icemaker 32 to the rear wall 44, as is shown in FIGS. 28-32.

The casing 48 that forms the ice compartment walls 26 may be made from an injection molded urethane foam surrounded by a plastic wrapping. Alternatively, the casing may be a hollow part that is filled with foam insulation. Typically the walls will be about 1 inch to 1.5 inches thick. They need to provide sufficient insulation to prevent condensation from forming on the exterior of the walls within the fresh food compartment 14. They should also have sufficient structural integrity that the top wall of the casing 46 can act as a shelf on which fresh food may be stored.

Figure 6:
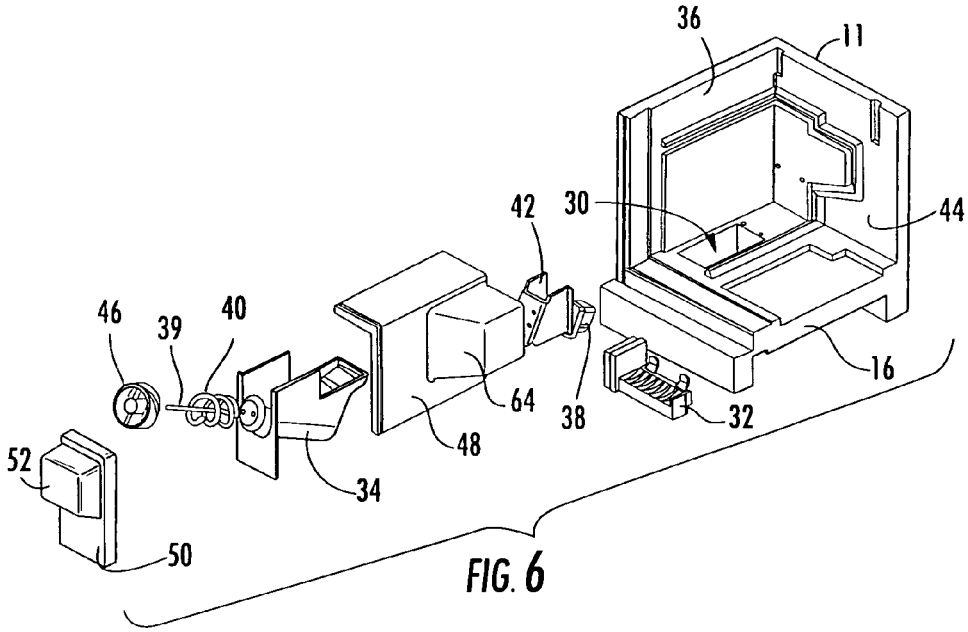
FIG. 6 is an exploded view of several components of another exemplary embodiment of the present invention showing a bottom mount refrigerator with an ice making compartment provided in a lower corner of the fresh food compartment.
Figure 7:
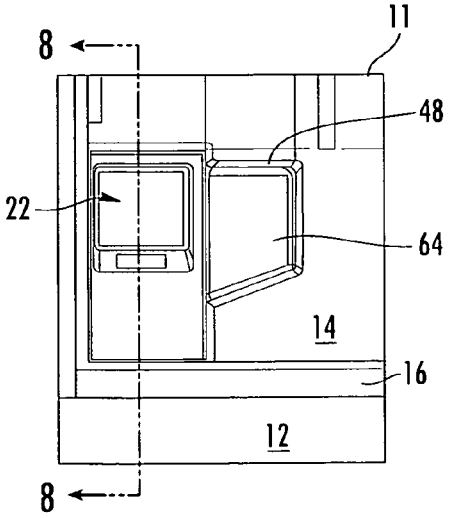
FIG. 7 is a front view of a portion of a refrigerator cabinet incorporating the components of FIG. 6.
Figure 8:
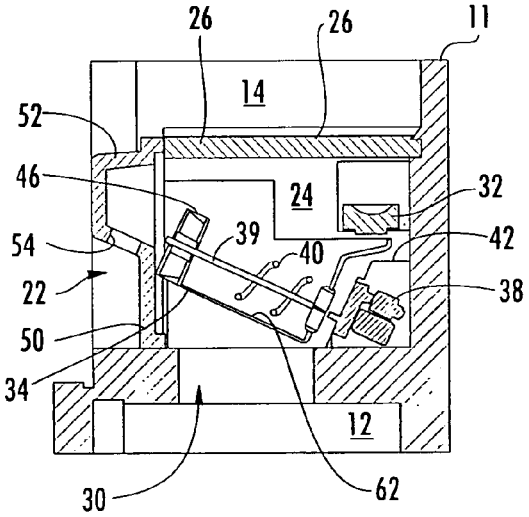
FIG. 8 is a cross-sectional view of the refrigerator FIG. 7 taken along line 8-8.

FIGS. 6-8 illustrate another embodiment of the present invention wherein the ice compartment 24 is located at a lower corner of the fresh food compartment 14. FIG. 6 shows an exploded view of the components that form the ice compartment 24. The primary difference between the embodiment of the embodiment of FIGS. 6-8 as compared to FIGS. 3-5 is that the icemaker 32 is mounted transversely to the back wall 44 of the cabinet 11. As a result, the case 48 that forms the ice compartment walls 26 includes an outcropping 64 to accommodate the icemaker 32.

Figure 9:
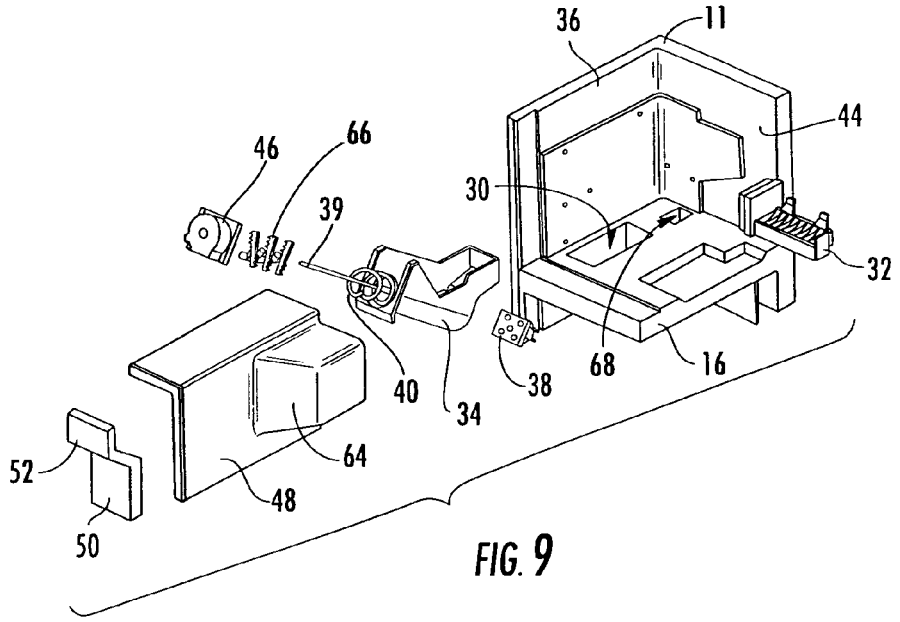
FIG. 9 is an exploded view of several components of another exemplary embodiment of the present invention showing a bottom mount refrigerator with an ice making compartment provided in a lower corner of the fresh food compartment.
Figure 10:
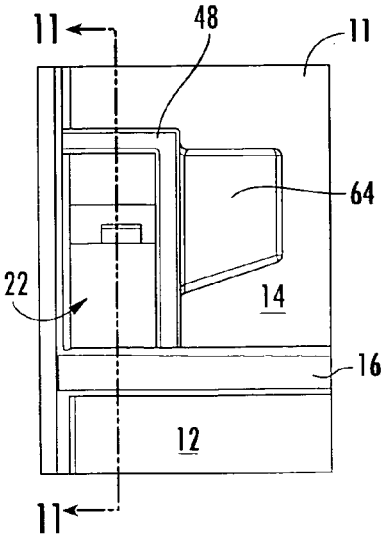
FIG. 10 is a front view of a portion of a refrigerator cabinet incorporating the components of FIG. 9.
Figure 11:
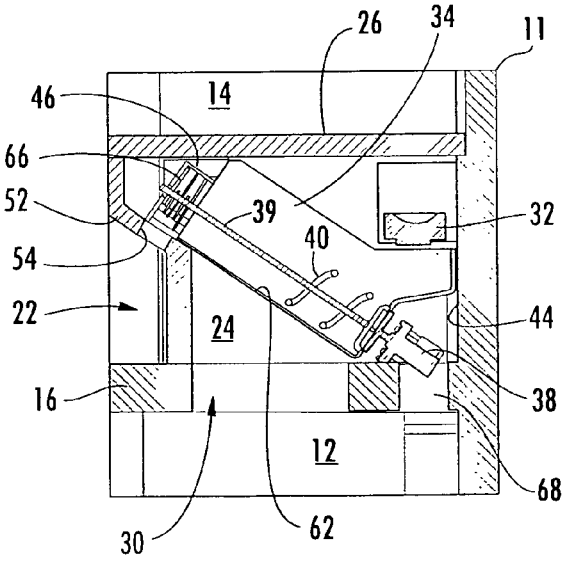
FIG. 11 is a cross-sectional view of the refrigerator FIG. 10 taken along line 11-11.

FIGS. 9-11 show yet another embodiment of the present invention wherein the ice compartment 24 is located at a lower corner of the fresh food compartment 14. The embodiment of FIGS. 9-11 is similar to the embodiment of FIGS. 6-8 in that the icemaker 32 is mounted to the rear wall 44 of the cabinet 11. The ice compartment cover 50 is an alternative design wherein the front of the cover 50 is recessed under the front edge of the ice storage container 34. The dispenser 46 includes ice crushers 66 to optionally provided crushed ice, rather than cubes of ice. A second opening 68 may be included between the freezer compartment 12 and the fresh food compartment 24. This second opening will permit the motor 38 to extend downward beyond the top surface of the divider wall 16 so that a greater angle can be achieved with the sloped surface 62 of the ice container 34.

Figure 12:
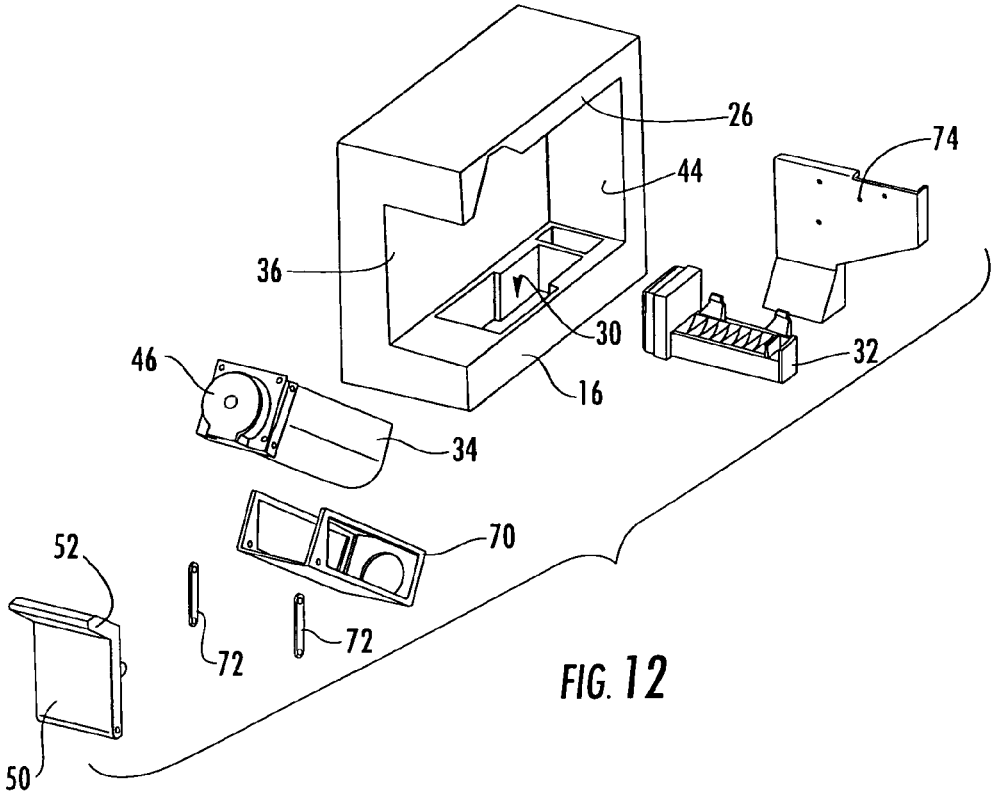
FIG. 12 is an exploded view of several components of another exemplary embodiment of the present invention showing a bottom mount refrigerator with an ice making compartment provided in a lower corner of the fresh food compartment with a pull-out storage container.
Figure 13:
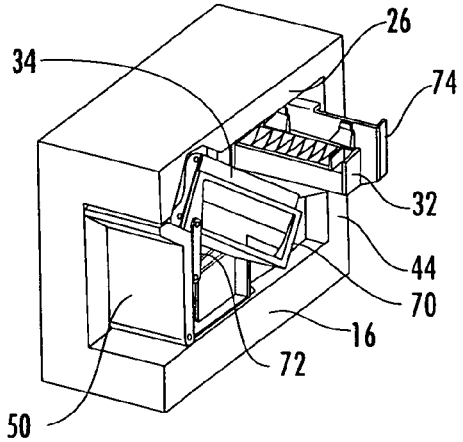
FIG. 13 is a perspective view of the components of FIG. 12 assembled into a portion of a refrigerator.
Figure 14:
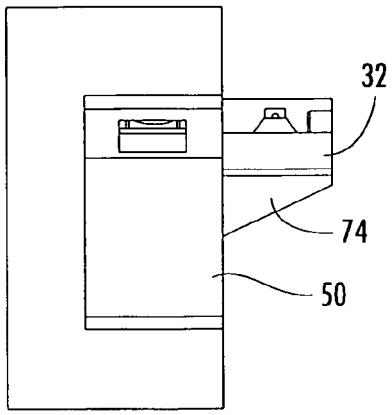
FIG. 14 is a front view of a portion of a refrigerator cabinet incorporating the components of FIG. 12.

FIGS. 12-14 show another embodiment of the present invention wherein the ice compartment 24 is located at a lower corner of the fresh food compartment 14. According to this embodiment the ice container 34 has a rotatable pullout design. The front cover 50, is hinged to the cabinet 11. The ice container 34 is slidably mounted on a rack 70. The rack 70 is rotatably mounted to the side wall 36 at its lower rear end. Links 72 connect the front bottom edge of the rack 70 with the front cover 50. At the rear of the ice compartment 24, an air duct 74 is provided to route air directly from the evaporator via second opening 68 to the rear top of the ice compartment 24 near the icemaker 32. This cold air will tend to flow across the icemaker 32 and then down through opening 30 back into the freezer compartment 12. Dumping the cold evaporator air directly onto the icemaker 34 maximizes the rate at which ice can be made. The icemaker 32 can be mounted to the duct 74, rather than directly to the rear wall 44.

Figure 15A:
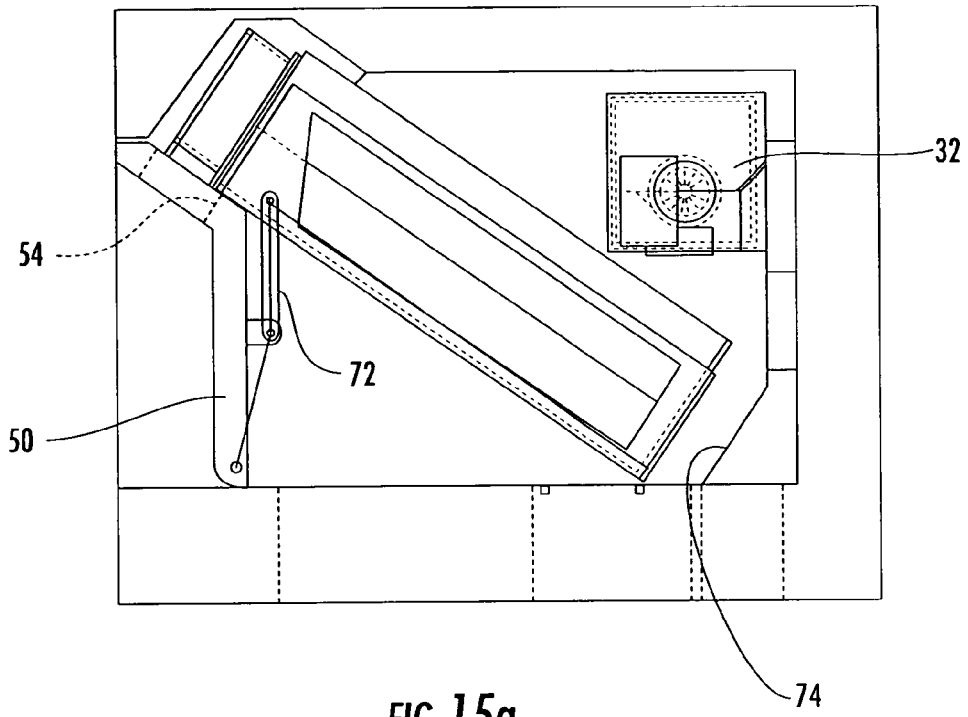
FIG. 15*a* is a side cross section of the refrigerator portion of FIG. 14, with the ice compartment door closed.
Figure 15B:
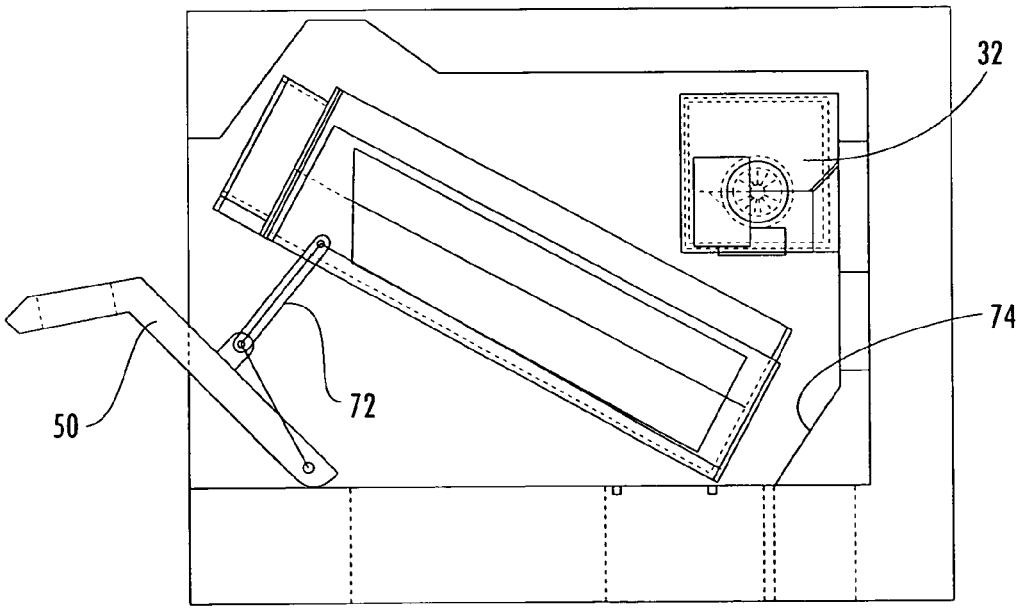
FIG. 15*b* is a side cross section of the refrigerator portion of FIG. 14, with the ice compartment door partially opened.
Figure 15C:
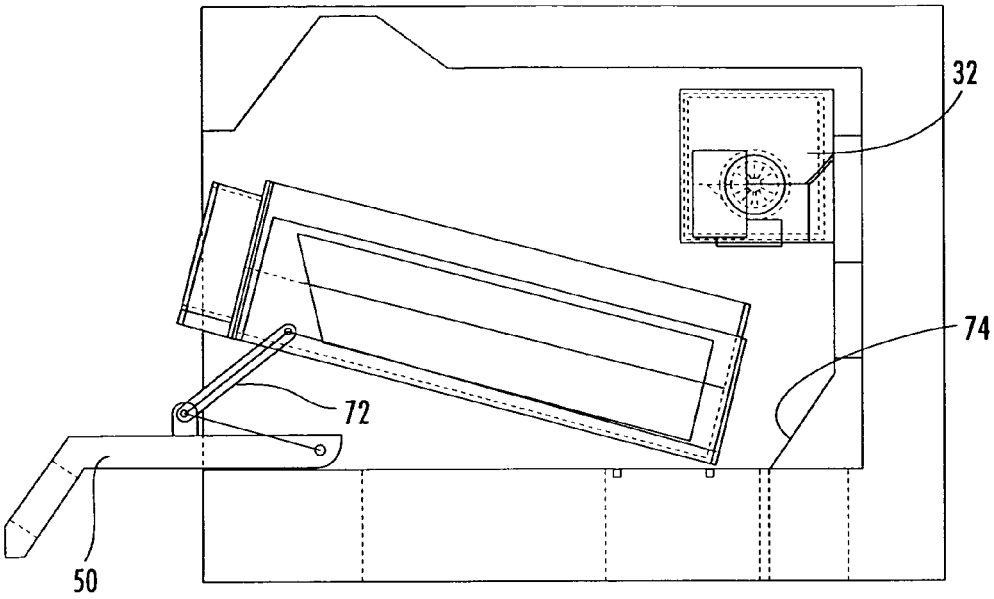
FIG. 15*c* is a side cross section of the refrigerator portion of FIG. 14, with the ice compartment door fully opened.
Figure 15D:
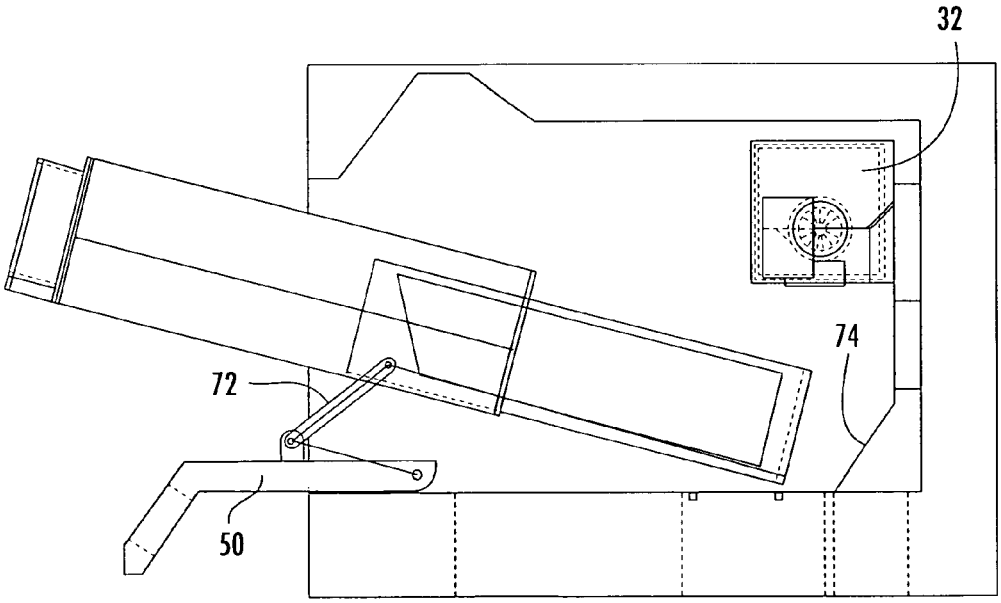
FIG. 15*d* is a side cross section of the refrigerator portion of FIG. 14, with the ice compartment door fully opened and the ice container pulled out.

FIGS. 15*a-d* illustrate a sequence whereby the ice storage container 34 of FIGS. 12-14 is rotated down and pulled forward out of the cabinet 11 to provide access to the stored ice. In FIG. 15*a*, the cover 50 is in a fully closed and sealed position completely covering the opening to the ice compartment 24. The links 72 are generally vertical, and the dispenser 46 is aligned with the opening 54 through the cover 50 so that the dispensing mechanism is ready to dispense ice into the dispensing area 22. In FIG. 15*b*, the cover 50 has been rotated partially open. The links 72 have pulled the rack 70 down slightly from its operable position. In FIG. 15*c*, the cover 50 has been completely opened so that it is resting flat against the top surface of the divider wall 16. The rack 70 is dropped down to its lowest position. In FIG. 15*d*, the rack 70 is in the fully lowered position of FIG. 15*c*, but the ice container 34 has been slid forward so that it extends partially beyond the front of the ice compartment 24 so that a user can access ice in the ice container 34 directly. Therefore, if a user wishes to have access to the ice in the ice container 34, the user can pull the front cover 50 downward in the fully open position, and then sliding the container 34 outward. The opening of the cover 50 should deactivate the trigger mechanism so that the motor 38 will not run when the cover 50 is open.

Figure 16:
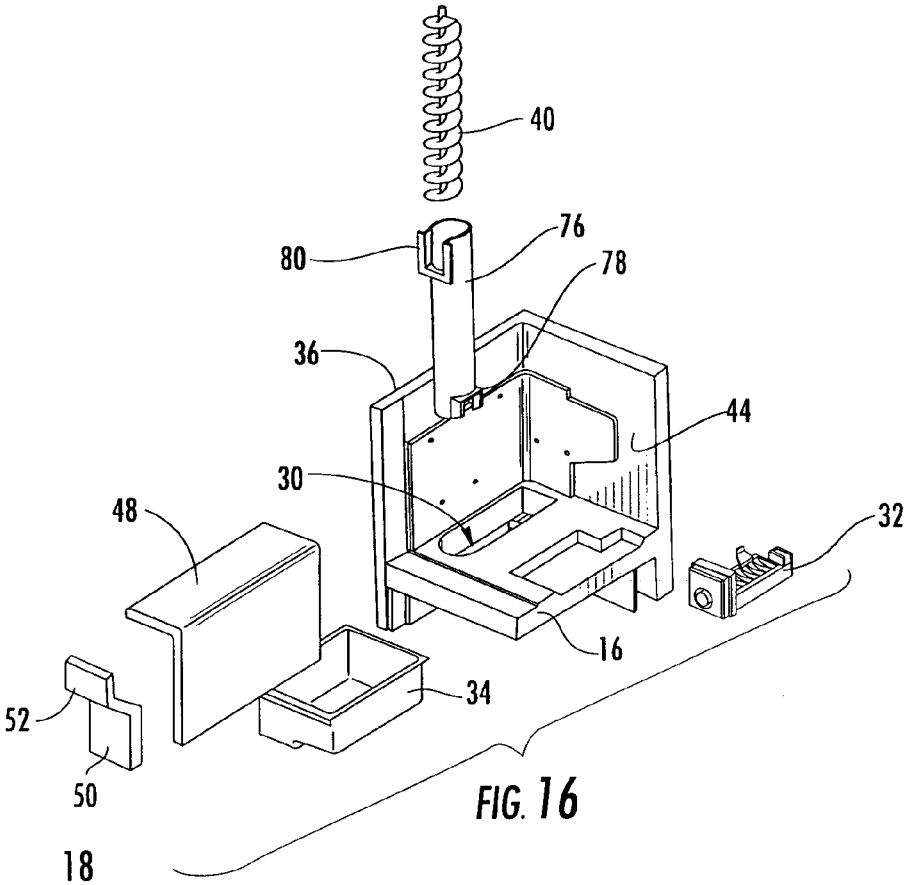
FIG. 16 is an exploded view of several components of another exemplary embodiment of the present invention showing a bottom mount refrigerator with an ice making compartment provided in a lower corner of the fresh food compartment having a storage container in the freezer compartment and using a solid tube and auger arrangement to lift the ice from the storage compartment to the dispensing area.
Figure 17:
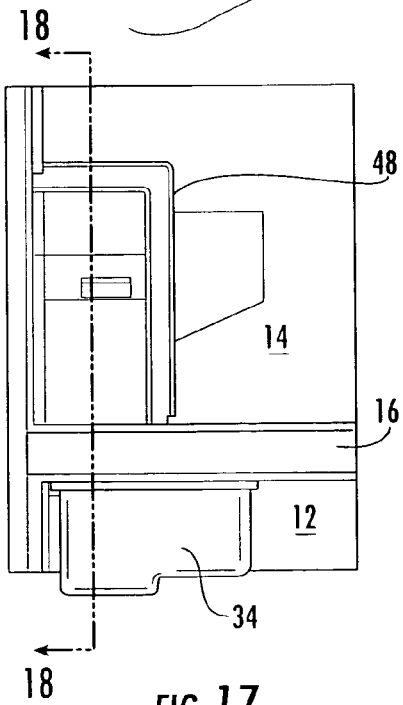
FIG. 17 is a front view of a portion of a refrigerator cabinet incorporating the components of FIG. 16.
Figure 18:
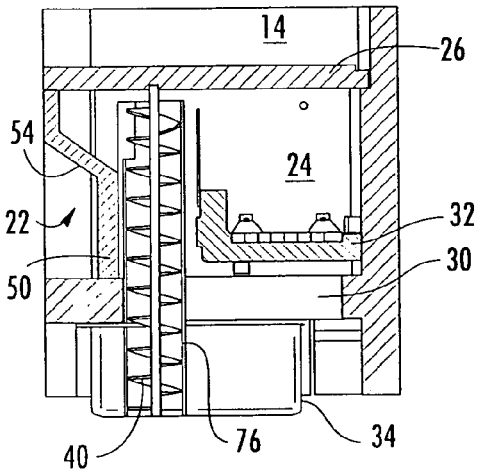
FIG. 18 is a cross-sectional view of the refrigerator FIG. 17 taken along line 18-18.
Figure 19:
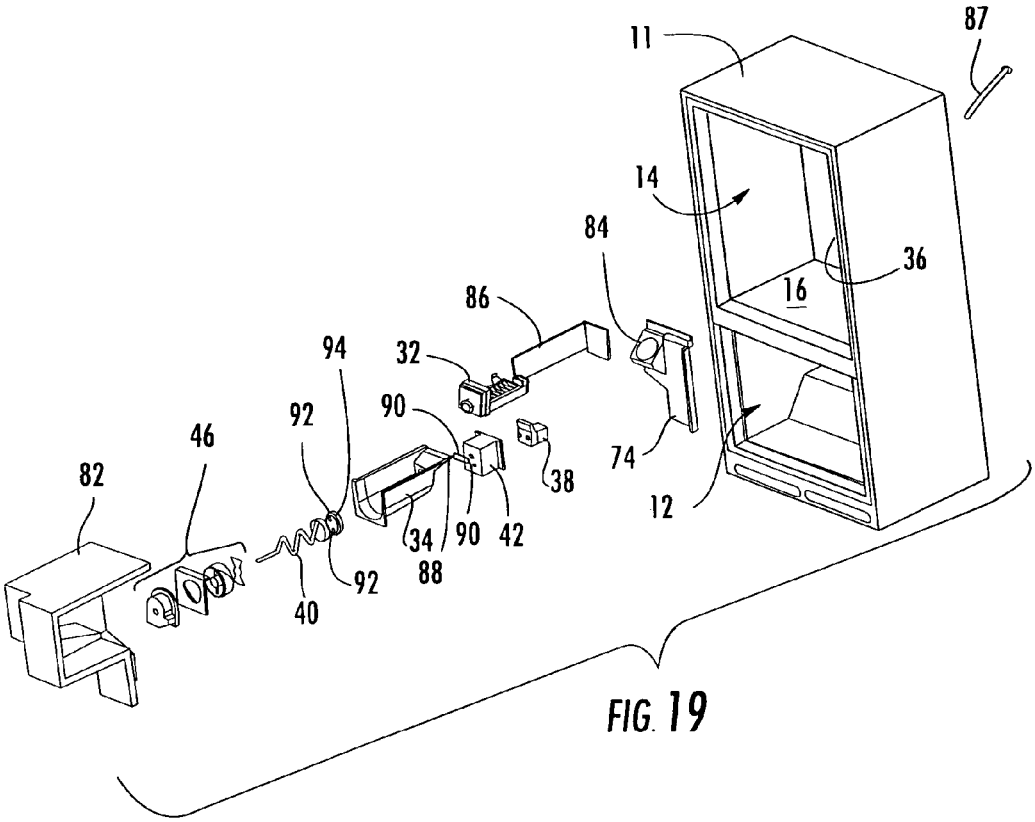
FIG. 19 is an exploded view of several components of an exemplary embodiment of the present invention showing a bottom mount refrigerator with an ice making compartment provided along a sidewall of the fresh food compartment.
Figure 20:
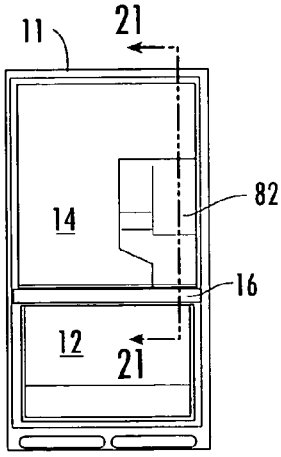
FIG. 20 is a front view of a bottom mount refrigerator cabinet according to the present invention including the components of FIG. 19.
Figure 21:
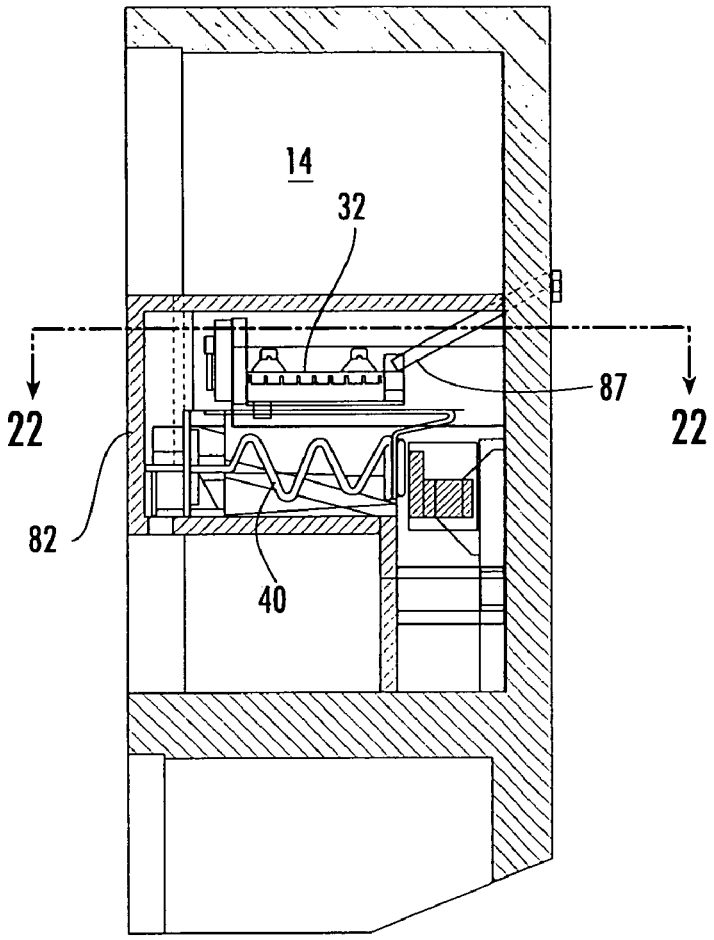
FIG. 21 is a cross-sectional view of the cabinet from FIG. 20 taken along line 21-21.
Figure 22:
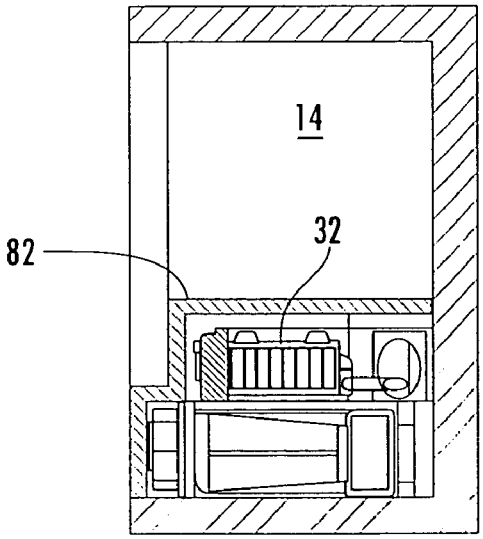
FIG. 22 is a cross-sectional top view of the cabinet of FIG. 20 taken along lines 22-22.
Figure 23:
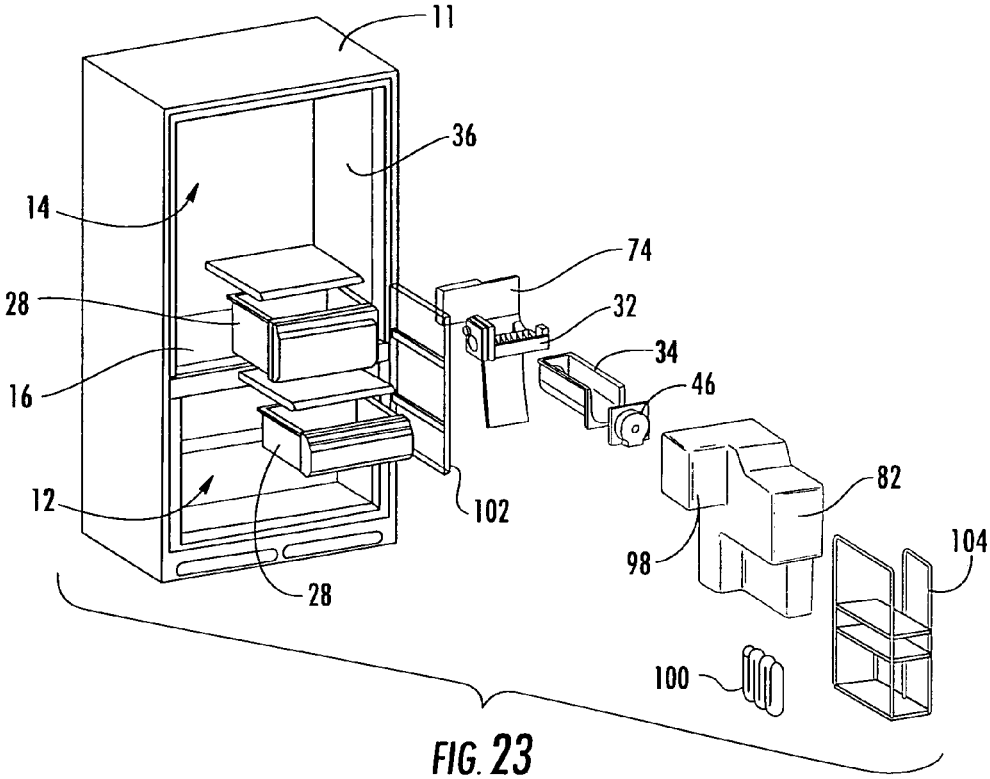
FIG. 23 is an exploded view of several components of an exemplary embodiment of the present invention showing a bottom mount refrigerator cabinet with an ice making compartment provided along a sidewall of the fresh food compartment with the ice maker mounted along the rear wall of the fresh food compartment.
Figure 24:
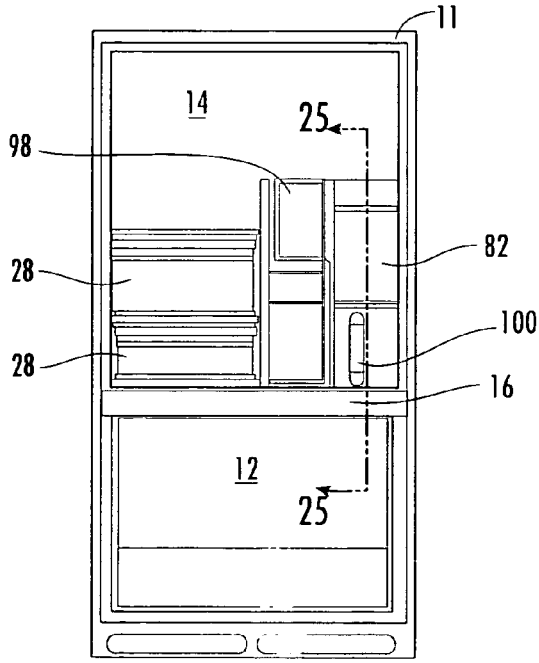
FIG. 24 is a front view of a bottom mount refrigerator cabinet according to the embodiment of FIG. 23.
Figure 25:
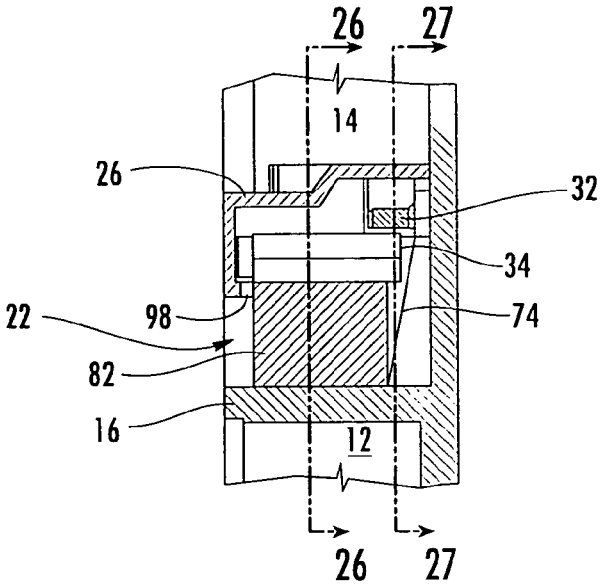
FIG. 25 is a cross-sectional view of the bottom mount refrigerator cabinet of FIG. 24 taken along line 25-25.
Figure 26:
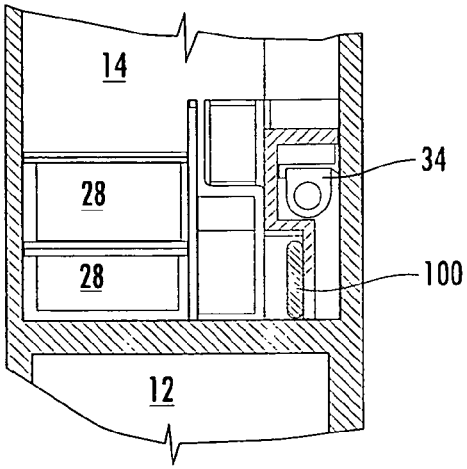
FIG. 26 is a cross-sectional view of the bottom mount refrigerator cabinet of FIG. 25 taken along line 26-26.
Figure 27:
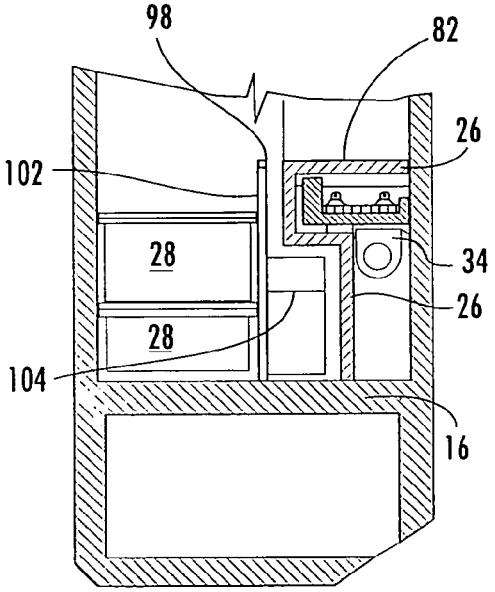
FIG. 27 is a cross-sectional view of the bottom mount refrigerator cabinet of FIG. 25 taken along line 27-27.
Figure 28:
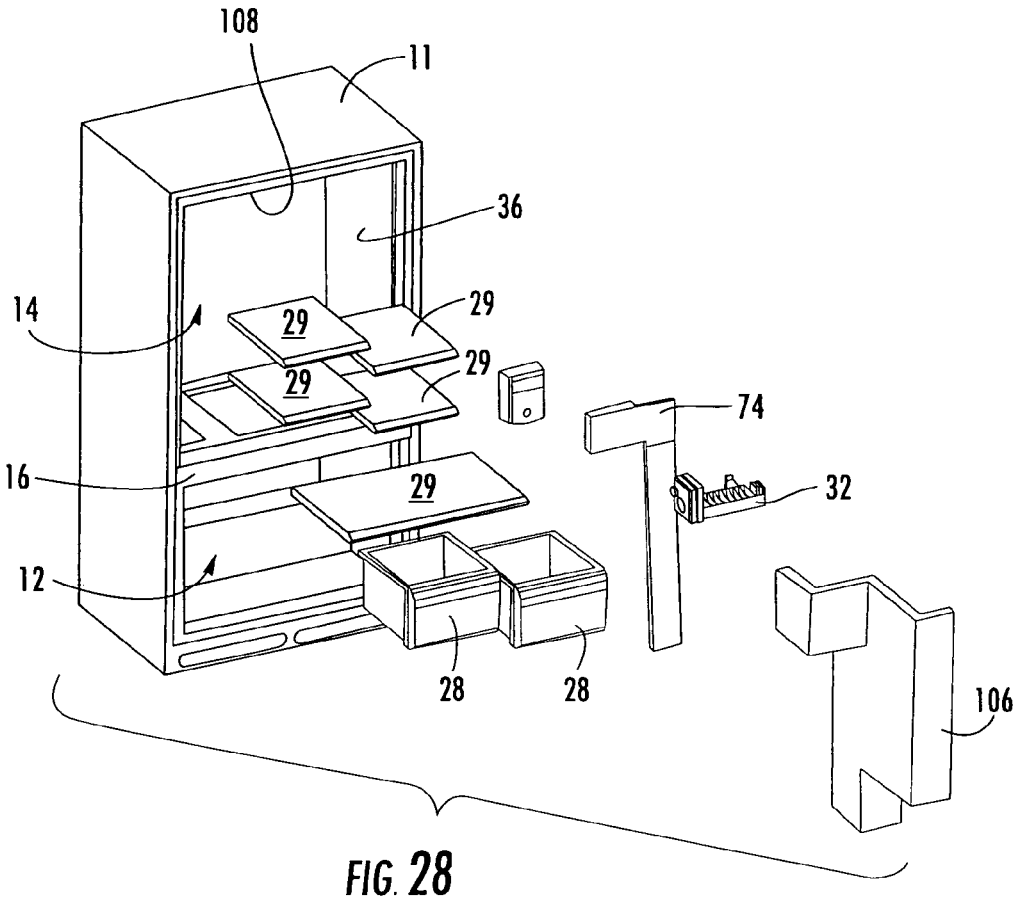
FIG. 28 is an exploded view of several components of an exemplary embodiment of the present invention showing a bottom mount refrigerator cabinet with an ice making compartment provided at the top of the fresh food compartment with the ice maker mounted along the rear wall of the fresh food compartment.
Figure 29:
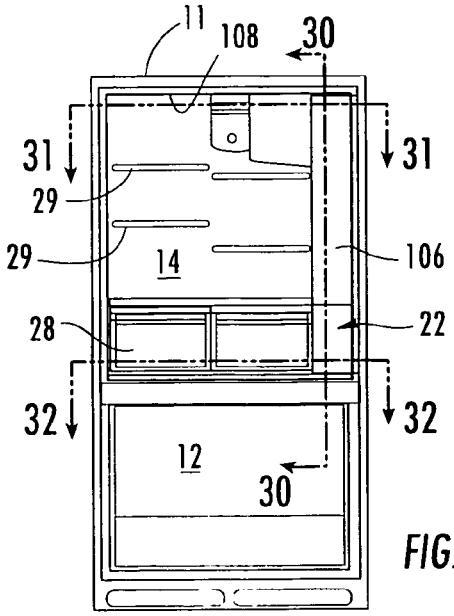
FIG. 29 is a front view of a bottom mount refrigerator cabinet according to the embodiment of FIG. 28.
Figure 30:
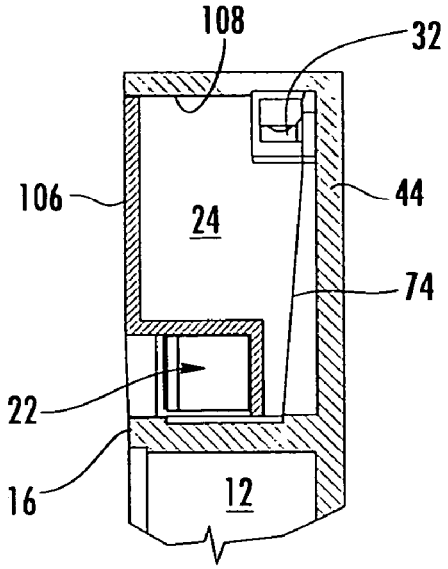
FIG. 30 is a cross-sectional view of the bottom mount refrigerator cabinet of FIG. 29 taken along line 30-30.
Figure 31:
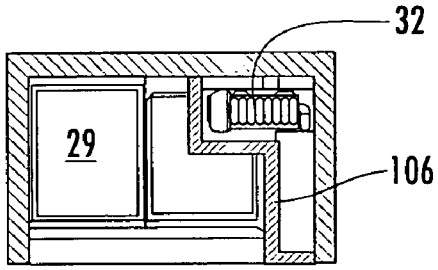
FIG. 31 is a cross-sectional view of the bottom mount refrigerator cabinet of FIG. 29 taken along line 31-31.
Figure 32:
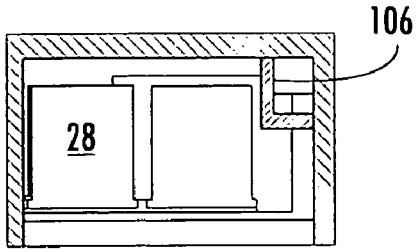
FIG. 32 is a cross-sectional view of the bottom mount refrigerator cabinet of FIG. 29 taken along line 32-32.

FIGS. 16-18 show an additional embodiment of the present invention wherein the ice compartment 24 is located at a lower corner of the fresh food compartment 14. According to this embodiment a tube 76 and solid-flighted auger 40 are used to lift ice from the storage container 34 that is located in the freezer compartment 12 to the dispensing location 22 provided in the upper door 18. The icemaker 32 is mounted in the ice compartment 24. As ice is made, it drops through the opening 30 into the ice container 34 in the freezer compartment 12. An intake opening 78 is provided at the bottom of the tube 76 to permit ice within the ice container 34 to enter the tube 76. A motor (not shown) may be provided at the top or bottom of the auger 40 to rotate the auger 40 in order to lift ice up the tube 76. As the auger 40 rotates, ice will be lifted by the solid flights of the auger up the tube 40 until it reaches a discharge opening 80. The ice is expelled through the discharge opening to the area above the protrusion 52 of the front cover 50 and then falls through the opening 54 into the dispensing area 22. The ice compartment 34 is preferably a drawer-like structure that can be pulled outward from the freezer compartment 12 to provide access to the stored ice.

Mid-Wall Ice Compartment Embodiments

As an alternative to locating the ice compartment 24 at the lower corner of the fresh food compartment 14, FIGS. 19-22 show an embodiment where the ice compartment 24 is located mid way along one of the sidewalls 36 of the cabinet 11. A casing 82 is provided to enclose the ice compartment within the fresh food compartment 14 along one of the sidewalls 36 of the cabinet 11 of a bottom mount refrigerator. The casing 82 is sealed along the rear wall 44, sidewall 36 and divider wall 16 to enclose the ice compartment 24. A front portion of the casing 82 may be removable to provide access to the ice compartment 24. Preferably the casing 82 is insulated to allow for a temperature difference between the ice compartment 24 and the fresh food compartment 14. An air duct 74 is provided at the rear of the ice compartment 24 to provide cold air from the evaporator to the ice compartment 24 through opening 84. Bracket 86 fastens to rear wall 44 to provide a mounting bracket for icemaker 32. A water line fill tube 87 supplies water to the icemaker 32. Motor 38 turns spindle 88 that has two prongs 90 that engage ribs 92 in disk 94 associated with auger 40. The dispenser assembly 46 is provided at the end of the auger 40 to slowly dispense ice to the dispensing area 22 through an aperture 96 formed on a lower surface of the casing 82.

The mid sidewall arrangement of FIGS. 19-22 is advantageous over the above described arrangements that have the ice compartment at a lower corner of the fresh food compartment 14 in that there is no need to lift the ice to a higher level to reach an acceptable dispensing location 22. For this reason, conventional ice dispenser mechanisms are well suited for use in ice compartment 24 mounted along one of the sidewalls 36. The mid sidewall arrangement of FIGS. 19-22 is somewhat disadvantageous in that it breaks up the usable space in the fresh food compartment 14, and takes up a little additional space within the fresh food compartment because of the air duct 74 at the rear of the compartment that is not external in to bottom of the fresh food compartment embodiments of FIGS. 1-21.

FIGS. 23-27 show another embodiment of the present invention that utilizes an ice compartment 24 mounted at an intermediate location on one of the sidewalls 36 of the fresh food compartment 14. The embodiment of FIGS. 23-27 is similar to the embodiment of FIGS. 19-22, except that the icemaker 32 is mounted parallel to the rear wall 44, rather than parallel to one of the side walls 36. The icemaker 32 may be mounted directly to the rear wall 44, or, may be mounted to the air duct 74. This orientation for the icemaker 32 is less efficient from a space stand point because it requires a lateral extension 98 on the side of the casing 82 to accommodate the icemaker 32. However, this orientation provides a simpler and more stable mounting location for the icemaker 32.

As with the embodiment of FIGS. 19-22, the ice drops from icemaker 32 into the storage container 34. The dispensing mechanism can selectively dispense the ice through the aperture 98 in response to activation by a trigger mechanism. The embodiment of FIGS. 23-27 also includes a water reservoir 100 to retain water that can be dispensed at the dispensing area 22. The water reservoir 100 is exterior to the ice compartment so that the water will not freeze, but will be chilled by the air within the fresh food compartment 14. It should be noted that both of the embodiments in FIGS. 19-22 and FIGS. 23-27 utilize relatively small ice storage containers 34 within the ice compartment 24 in order to minimize the space taken away from the fresh food compartment 14. It may be desirable to provide a second ice storage container in the freezer compartment 12 in order to store enough ice for heavy usage periods. Shelves 104 may be provided along side the casing 82 to facilitate storage of food in the space adjacent to the casing 82 and beneath the extension 98 within the fresh food compartment 14. A support structure 102 can be provided beside the shelves 104 to support the crisper drawers 28 or shelves within the fresh food compartment 14.

High Mount Ice Compartment Embodiments

FIGS. 28-32 show an embodiment of the present invention that utilizes an ice compartment 24 located at an upper corner of the fresh food compartment 14. The ice compartment 24 is formed by the top wall 108, the side wall 36, the rear wall 44, and insulated casing 106 that seals the ice compartment 24 from the fresh food compartment 14. The air duct 74 provides cold air from the evaporator to the ice maker 32 at the rear wall 44. The ice maker 32 can be mounted to the air duct 74, or directly to the rear wall 44. Shelves 29 and crispers 28 mount alongside the casing 106 to provide storage space for food within the fresh food compartment 14.

As ice is formed by the icemaker 32, it falls into the ice compartment 24 for loose storage above the dispensing area 22. Alternatively, the ice storage container 34 may be provided within the ice cavity 24 to retain the ice until it is dispensed. A dispensing mechanism, including an auger or breaker bar, similar to those discussed with the previous embodiments, may be included in the ice compartment to dispense the ice to the dispensing area 22.

Mounting the icemaker 32 at or near the top of the refrigerator cabinet 11 has the advantage of being able to use gravity to move the ice to the dispensing area. Having the icemaker 32 at or near the top of the fresh food compartment 14 also has a couple disadvantages. It is difficult to keep the evaporator air as cold when it is delivered to the ice compartment 24 because of the distance it must travel. As a result, the rate at which ice can be made may be reduced. The large casing 106 is visually unattractive, and takes up more storage space in the fresh food compartment 14 than the alternatives.

Figure 33:
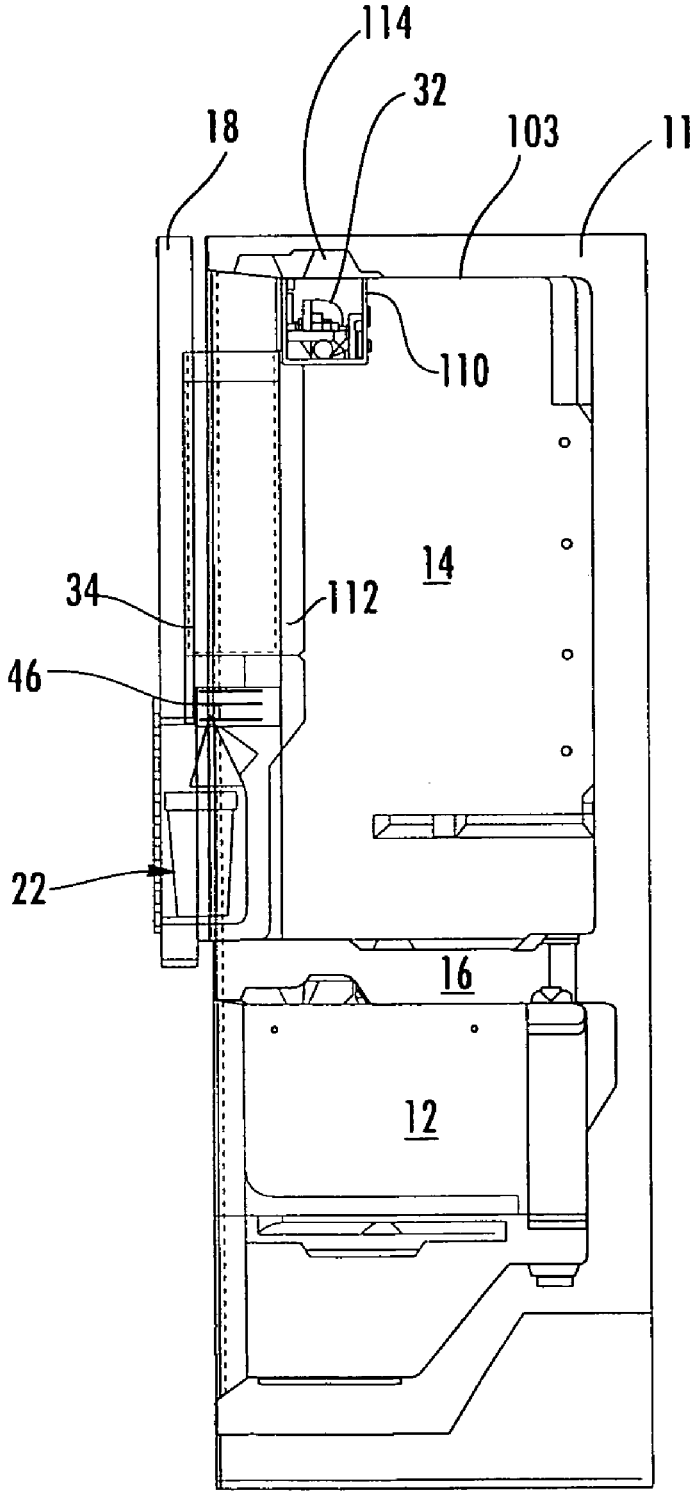
FIG. 33 is a side elevation cross section of an embodiment of a bottom mount refrigerator according to the present invention wherein an ice compartment is provided in the top door of the refrigerator and the ice maker is mounted at the top of the fresh food compartment.

Another embodiment with an ice compartment provided at the top of the fresh food compartment 14 is shown in FIG. 33. Importantly in this embodiment, the ice storage container 34 is provided within the top door 18 directly above the dispensing area 22. An insulated cover 110 mounts to the top wall 108 and covers and seals the icemaker 32 from the fresh food compartment 14. As ice is made it falls from the icemaker 32 into the storage container 34, either directly as shown in the figures, or by a sloped chute. The insulated ice compartment 24 is formed on the door 18 by the door compartment cover 112 to store the ice until it is dispensed. A trigger mechanism and dispenser 46 is provided to initiate the dispensing. A door or other covered opening may be provided through the door compartment cover 112 in order permit direct access to the stored ice in the ice container 34. Cold air from the evaporator is provided to the icemaker 32 and the storage container 34 via the air duct 114.

Other Features

Figure 34:
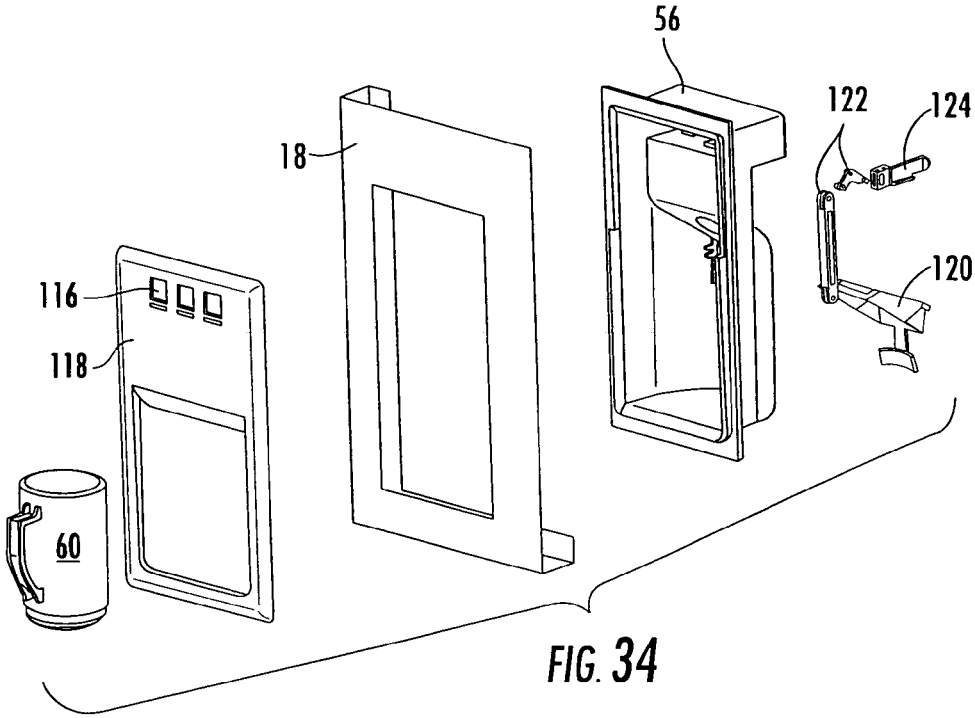
FIG. 34 is an exploded view of an embodiment of a triggering mechanism for use in the present invention.
Figure 35:
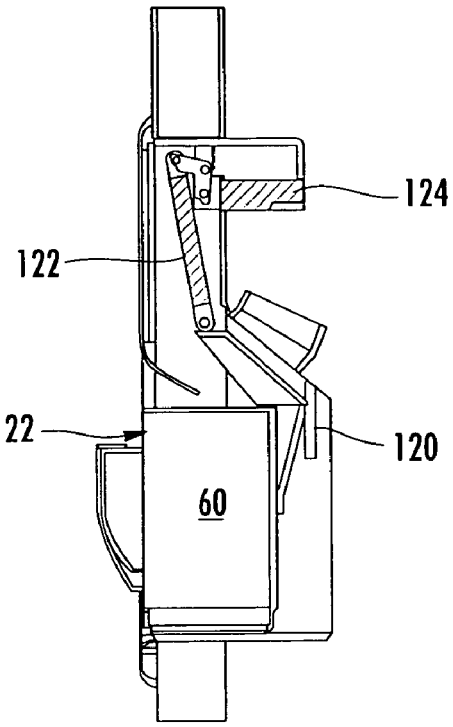
FIG. 35 is a cross-sectional side view of a triggering mechanism according to FIG. 34 in a non-activated state.
Figure 36:
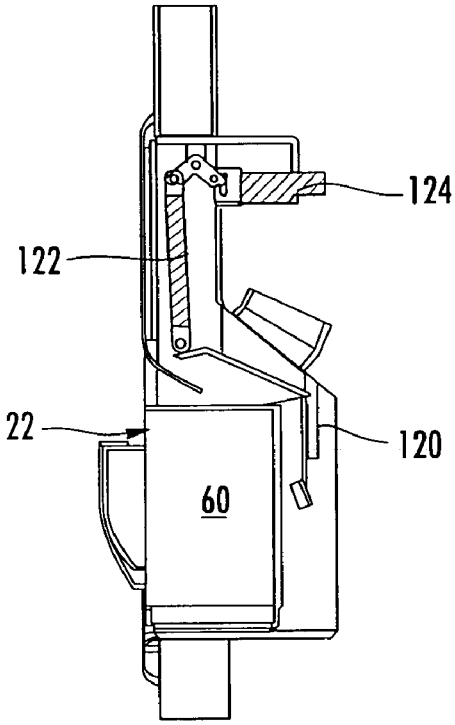
FIG. 36 is a cross-sectional side view of a triggering mechanism according to FIG. 34 in an activated dispensing state.

FIGS. 34-36 illustrate an embodiment of a trigger mechanism that can be used to activate a dispensing occurrence with any of the above described embodiments. Selection buttons 116 are provided on facing 118 that fits on the door 18 in alignment with the shell 56. The selection buttons 116 allow a user to choose a dispensing mode such as ice, water, or crushed ice. The shell 60 forms a cavity that defines the dispensing area 22. An activation lever 120 extends downwardly at the rear of the dispensing area 22. Activation lever 120 is connected to an activation switch 124 by a linkage assembly 122. To activate a dispensing occurrence, the cup or glass 60 is moved into the dispensing area 22 and pressed against activation lever 120. When activation lever 120 is pressed rearward, the linkage assembly 122 correspondingly moves the activation switch 124 outward to a closed position that activates a dispensing occurrence by starting any associated motors and by opening any necessary flaps or covers to allow passage of ice from the storage container 34 to the dispensing area 22. FIG. 35 shows the trigger mechanism in a normal rest position with the activation switch 124 withdrawn to a closed position. FIG. 36 shows the trigger mechanism in a dispense position with the cup 60 pressing against the lever 120 to move the activation switch to the extended closed position. It should be appreciated that rather than selection buttons 116, a sliding lever could be used to indicated the preferred dispensing mode. This mechanical trigger mechanism for activating the dispense system eliminates electrical wires which typically run through the door hinge pin and the door to the dispenser cavity area. Therefore, the door can more easily be removed and the swing of the door reversed by moving the hinge to the opposite side of the cabinet. Such swing reversal normally is not an issue on side-by-side models.

Figure 37:
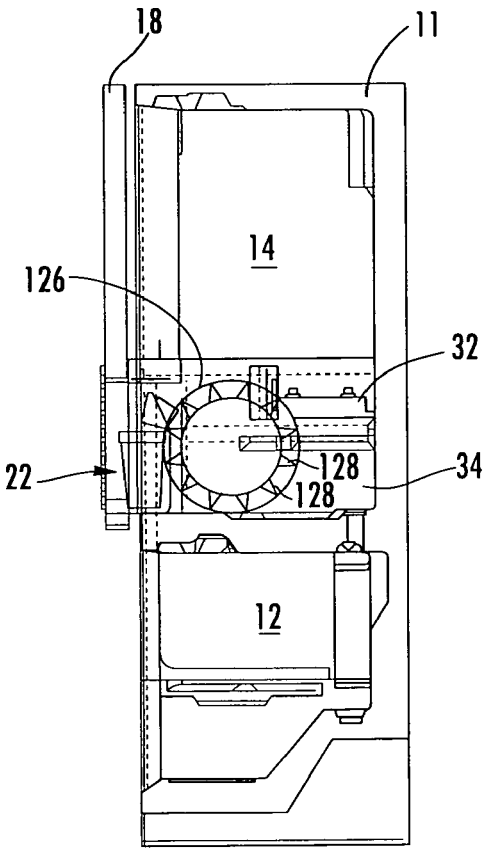
FIG. 37 is a cross-sectional side view of an embodiment of a bottom mount refrigerator according to the present invention utilizing a wheel-type dispensing mechanism.
Figure 38:
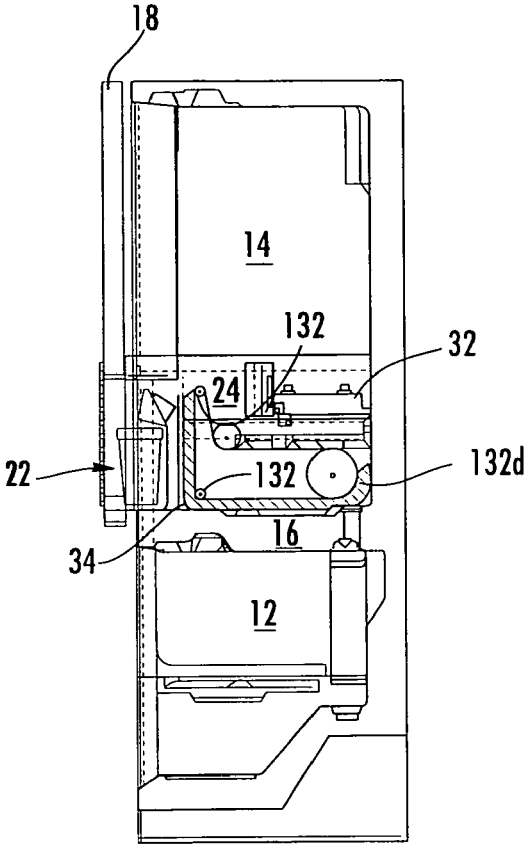
FIG. 38 is a cross-sectional side view of an embodiment of a bottom mount refrigerator according to the present invention utilizing a conveyor-belt dispensing mechanism.

In the above embodiments the dispensing mechanism described was generally an auger type dispenser. FIGS. 37 and 38 illustrate two alternative dispensing mechanisms that are especially well suited to use with the embodiments with the ice compartment 24 mounted at the bottom of the fresh food compartment 14. FIG. 37 shows a ferris-wheel arrangement, and FIG. 38 shows a conveyor belt type dispenser. Both of these embodiments' facilitate elevating ice to a dispensing location that is above the storage area for the ice.

With reference to FIG. 37, a wheel 126 is provided in the ice compartment 24 that extends downward into the storage container 34. Ice made by the ice maker 32 will fall into the storage container 34. The wheel 126 includes small scoops 128 that will retain ice cubes as the wheel 126 rotates (in a counter clockwise direction as viewed in FIG. 37). The scoops 128 will lift the ice cubes and dump them into the area directly above dispensing area 22, so that the cubes can then fall into dispensing area 22 by gravity. Separate motors (not shown) turn the wheel 126 and crush the ice, if that feature is desired. The wheel 126 is offset slightly from the dispensing area 22 so that it will not interfere with the dispensing area 22.

With reference to FIG. 38, a conveyor belt assembly is shown to lift the ice from the storage container 34 to a location above the dispensing area 22. A flexible belt 130 is wound around rollers 132. One of the rollers 132 is a driven roller 132*d* attached to a motor. The belt 130 can be tensioned by adjusting the rollers 132. Flaps 134 are provided that extend outwardly from the belt 130, preferably at an angle. The flaps 134 are positioned to scrape along the bottom of the storage container 34. When the driven roller 132 is rotated, the belt 130 translates around the rollers 132, and the flaps 134 push the ice upward to an area directly above the dispensing area 22, so that the ice can fall into the dispensing area 22.

What is claimed is:

1. A bottom mount refrigerator including only a single evaporator comprising:

a freezer compartment;

a fresh food compartment located above the freezer compartment, the fresh food compartment being maintained at or below 40° Fahrenheit;

a divider wall between said freezer compartment and said fresh food compartment;

an ice compartment within the fresh food compartment, the ice compartment including a plurality of walls, said plurality of walls including said divider wall and wherein said ice compartment is mounted to said divider wall;

an icemaker in the ice compartment;

insulation around the ice compartment to isolate the ice compartment from the fresh food compartment;

an air duct in communication with the ice compartment;

air at or below 32° Fahrenheit provided through said air duct and to said ice compartment;

a door for the fresh food compartment; and an ice dispenser in the door for dispensing ice from the ice compartment to a consumer.

2. The bottom mount refrigerator of claim 1, wherein the fresh food compartment has a top wall, a bottom wall, a back wall, and two side walls; and the sealed ice compartment is in contact with one of the side walls, but is not in contact with the bottom wall or the top wall.

3. The botton mount refrigerator of claim 1, wherein the freezer compartment, the fresh food compartment, and the sealed ice compartment are maintained at specified temperatures; and wherein an average specified temperature of the sealed ice compartment is greater than an average specified temperature of the freezer compartment, but less than an average specified temperature of the fresh food compartment.

4. A refrigerator comprising:

a single evaporator;

a fresh food compartment including a door with the fresh food compartment being maintained at or below 40° Fahrenheit;

a freezer compartment;

a divider wall between said freezer compartment and said fresh food compartment;

an insulated ice compartment located within the fresh food compartment, the ice compartment including a plurality of walls, said plurality of walls including said divider wall and wherein said ice compartment is mounted to said divider wall;

an air duct in communication with the ice compartment;

air at or below 32° Fahrenheit provided through said air duct and to said ice compartment;

an icemaker in the ice compartment; and an ice dispenser in the door to convey ice from the ice compartment and through the door.

5. The refrigerator of claim 4 wherein the ice compartment is located along one side of the fresh food compartment.

6. The refrigerator of claim 4 further comprising an inclined ice bin within the ice compartment to store ice.

7. The refrigerator of claim 6 further comprising an auger within the bin to convey ice from the bin.

8. The refrigerator of claim 4 wherein the ice compartment includes a door and a seal to provide an air tight closure for the ice compartment door.

9. The refrigerator of claim 4 wherein the insulated ice compartment is not located on the door of the fresh food compartment.

10. The refrigerator of claim 4 further comprising a freezer compartment with cold air communication from the freezer compartment to the ice compartment.

* * * * *

UNITED STATES PATENT AND TRADEMARK OFFICE

CERTIFICATE OF CORRECTION

PATENT NO. : 8,353,177 B2
APPLICATION NO. : 11/236126
DATED : January 15, 2013
INVENTOR(S) : Adamski et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 874 days.

Signed and Sealed this
Eighteenth Day of November, 2014

Michelle K. Lee

Michelle K. Lee
*Deputy Director of the United States Patent and Trademark Office*